US005620151A

United States Patent [19]

Ueyama et al.

[11] Patent Number: 5,620,151

[45] Date of Patent: Apr. 15, 1997

[54] AUTOMATIC SLITTER REWINDER MACHINE

[75] Inventors: Minoru Ueyama, Katano; Yoshiteru Kosuga, Osaka, both of Japan

[73] Assignee: Kabushiki Kaisha Fuji Tekkosho, Osaka, Japan

[21] Appl. No.: 606,497

[22] Filed: Feb. 23, 1996

Related U.S. Application Data

[63] Continuation of Ser. No. 188,239, Jan. 28, 1994, abandoned.

[30] Foreign Application Priority Data

| | | | |
|---|---|---|---|
| Feb. 5, 1993 | [JP] | Japan | 5-042082 |
| Jun. 30, 1993 | [JP] | Japan | 5-189461 |
| Jul. 7, 1993 | [JP] | Japan | 5-193140 |

[51] Int. Cl.[6] ..... B65H 18/10

[52] U.S. Cl. ..... 242/530; 242/533; 242/533.8; 242/547

[58] Field of Search ..... 242/530, 530.4, 242/547, 533.8, 533

[56] References Cited

U.S. PATENT DOCUMENTS

| | | | |
|---|---|---|---|
| 3,389,592 | 6/1968 | Bournez et al. | 242/533 X |
| 3,883,085 | 5/1975 | Held . | |
| 4,055,313 | 10/1977 | Yamaguchi et al. . | |
| 4,131,206 | 12/1978 | Kawada et al. . | |
| 4,346,852 | 8/1982 | Kawada et al. | 242/533 X |
| 4,398,678 | 8/1983 | Kron et al. | 242/530.4 X |
| 4,682,929 | 7/1987 | Kataoka | 242/533.8 X |
| 4,770,360 | 9/1988 | Liebelt | 242/530 |
| 4,854,806 | 8/1989 | Gertsch et al. | 242/533.8 X |
| 4,875,632 | 10/1989 | Kataoka | 242/530 |
| 5,402,960 | 4/1995 | Oliver et al. | 242/547 X |

FOREIGN PATENT DOCUMENTS

| | | | |
|---|---|---|---|
| 3811159A1 | 10/1988 | Germany . | |
| 3629024C2 | 5/1991 | Germany . | |
| 1037650A | 2/1986 | Japan | 242/533 |
| 1-197257A | 8/1988 | Japan . | |
| 4-75865 | 7/1992 | Japan . | |
| 341100 | 10/1959 | Switzerland . | |

*Primary Examiner*—Daniel P. Stodola
*Assistant Examiner*—William A. Rivera
*Attorney, Agent, or Firm*—Flynn, Thiel, Boutell & Tanis, P.C.

[57] ABSTRACT

Automatic slitter rewinder machine which includes a plurality of pairs of core-holding frames for releasably mounting a core therebetween and for winding up on the cores slit narrow web sheets to full rolls and automatic delivery apparatus for cooperating with the pairs of core-holding frames after winding-up to conduct a series of automatic roll changing steps for the next winding. The pairs of core-holding frames are suspended to be slidably movable. The automatic delivery apparatus is disposed below the pairs of core-holding frames and has a roll delivery carriage including a wrapping device for cut trailing ends of unloaded full rolls, a carriage for transferring the full rolls outside the machine, a conveyor for carrying and discharging the rolls, and a lifter for the conveyor, the wrapping device having swing rollers capable of moving toward and away from each other so as to conduct the wrapping and to carry the full rolls onto the conveyor. A core-feeding lift including a vertically movable horizontal member is provided, with travellers being slidable on the horizontal member. Core-holding devices are mounted on the travellers and each have a self-aligning property to the pairs of core-holding frames.

19 Claims, 20 Drawing Sheets

AUTOMATIC SLITTER REWINDER MACHINE

This application is a continuation of U.S. Pat. Ser. No 08/188,239, filed Jan. 28, 1994, now abandoned.

BACKGROUND OF THE INVENTION

1. Field of the Invention

This invention relates to an automatic slitter rewinder machine for slitting lengthwise a web continuously supplied into a plurality of narrow-width webs, dividing the narrow webs at both fore and aft sides of the machine and winding up the respective narrow webs in roll form, and more particularly, to a slitter rewinder machine in which the change-over for next winding is automatized.

2. Statement of Related Art

A slitter rewinder is to unwind a wide web roll fed from outside, slit it into a plurality of narrow webs with a slitter and wind the narrow webs up on cores of core holders of winders disposed at fore and aft sides of the machine, thereby to yield full rolls.

When the narrow webs are wound up to a required diameter, the resulting full-wind rolls are removed out of the core holders, the trailing ends of the webs are cut, new cores are mounted on the core holders, and the leading ends are wrapped about the new cores, thus being prepared for next winding. A series of the roll change works for next winding have been heretofore performed by manual operation.

In order to enhance the production efficiency of an overall slitter rewinder machine, speed up of the roll changing works as well as the winding performances of the machine are essential requisites. To that end, various expedients for facilitating the roll changing works for next winding have been proposed, but exclusively manual means. One of the expedients includes a slitter rewinder machine proposed by one of the inventors, wherein an improvement is made in that core holders are disposed on the upper machine frames in hanging manner instead of having been installed, so far, on the floor of the machine, whereby a large working place is ensured in the lower place of the machine to make the manual roll changing works extremely easy (Japanese U.M. No. 4-75865 (1992)). However, there exists no slitter rewinder machine such that the roll changing works for next winding are automatized.

This invention is designed to further improve on the aforementioned slitter rewinder machine by disposing a mechanism for automatizing the roll change works for next winding in the lower space of the machine, and accordingly, a primary object of this invention is to automatize the roll changing works for next winding and to enhance the production efficiency of the slitter rewinder machine.

SUMMARY OF THE INVENTION

The present invention for attaining the foregoing object consists broadly in an automatic slitter rewinder machine which comprises an unwinder for supplying continuously a wide web sheet; a take-off apparatus for guiding the wide web sheet to a winding position; a slitter apparatus for slitting the wide web sheet thus guided into narrow web sheets; winding apparatuses for winding up the narrow web sheets on cores, each of the winding apparatuses including pairs of core-holding frames and touch rollers for abutting on respective cores during winding, the core-holding frames being disposed to be slidably movable in longitudinal and lateral directions on upper frames of the machine at fore and aft sides thereof in a suspended manner; delivery apparatuses for removing and transferring full-wind rolls and feeding new cores to the core-holding frames in unoccupied state, the delivery apparatuses each including a carriage equipment of full rolls and a lifting equipment for supply of new cores and being disposed on the floor of the machine below the winding apparatuses to be movable up and down; and cutters for cutting the narrow web sheets of the full rolls, the winding apparatuses and the delivery apparatuses being adapted to be controlled so as to enable automatic sequential change-over operations for next winding of: delivery of full rolls, feeding of new cores, cutting of the narrow web sheets of the full rolls and wrapping of leading cut ends of the narrow web sheets around the new cores.

More specifically, the invention encompasses an automatic slitter rewinder machine, with which to slit a wide web sheet continuously supplied into narrow web sheets and to wind them up onto respective cores thereby yielding full rolls, which comprises an unwinder for continuously supplying a wide web sheet; guide means for guiding the wide web sheet; a slitter apparatus for slitting lengthwise the wide web sheet, thus guided, in a required slit number into a plurality of narrow web sheets; split guide rollers for guiding the narrow web sheets separately at fore and aft sides of the machine; core-holding frames, disposed in pairs of the slit number in a laterally spaced relation, for releasably mounting cores therebetween and capable of revolving the cores on which to wind up the narrow web sheets, the core-holding frames being located to be slidably movable in longitudinal and lateral directions on upper frames at fore and aft sides of the machine in a suspended manner; touch rollers for abutting on the respective narrow web sheets being wound on the cores while cooperating with the core-holding frames, the core-holding frames being slidably movable along the upper frames with the roll diameter build-up while retaining the abutting state on the touch rollers; carriages for delivering full rolls and core-feeding lifts both disposed to be movable up and down on the bottom of the machine below the core-holding frames; cutters, disposed near the touch rollers, for cutting the narrow web sheets of the full rolls in a widthwise direction on the new cores, as a cutting support, abutting on the touch rollers; lateral rails, mounted on both upper frames, for moving the core-holding frames in lateral directions in conformity with an intended slit width; longitudinal rails, mounted on the upper frames, for moving, after winding, the core-holding frames to a position (a) above the carriages, a position (b) above the lifts, and abutting position (c) on the touch rollers in this sequence; the carriages, lifts and core-holding frames being adapted to be controlled, while interlocking with the movement of the lontigudinal rails, so that at the position (a) the carriages are elevated to receive the full rolls from the core-holding frames, at the position (b) the core-feeding lifts are elevated to feed the core-holding frames with new cores, and at the position (c) the new cores are caused to abut on the touch rollers and the narrow web sheets each running between the touch roller and full roll are cut with the cutters on the new cores as a cutting support, whereby the roll changing operations for next winding are automatized.

In the machine above, the new cores fed with the core-feeding lifts are each preliminarily coated axially with an adhesive in a given width or attached axially with a pressure-sensitive tape of a given width, or alternatively charged with static electricity in the surroundings of the cut portions of the narrow web sheets.

According to another aspect of this invention, in order to enable simultaneous delivery of full rolls and simultaneous supply of new cores thus expediting the resumption of next winding, the automatic slitter rewinder machine is characterized in that the carriages for removing full rolls comprise each a carrying conveyor for transferring simultaneously the full rolls outside the machine; a lifter having a vertically movable table to elevate or lower the conveyor thereon so as to retain horizontally the conveyor and a wrapping equipment for wrapping the trailing ends of narrow web sheets around the full rolls including swing roller mechanisms located at both sides of the conveyor; the core-feeding lifts each comprise a horizontal member capable of ascending or descending, core-holding devices for holding new cores thereon, disposed to be slidably movable in conformity with the number of narrow web sheets, and tranveling members disposed to be slidably movable on the horizontal member and surmounted by the core-holding devices, thus enabling the core-holding devices to be slidably movable.

Preferably, each of the core-holding devices is of a pair of core-holding grips having a self-aligning property and being slidable in a symmetrical manner thereby to keep always the center position of each core unchangeable whenever the outside diameter of core is varied.

This invention further encompasses an automatic slitter rewinder machine characterized in that the slitter apparatus includes a positioning means for positioning automatically slitter knives to accommodate the slit width desired. That is, it comprises a first guide rail and a second guide rail disposed in parallel with each other in the widthwise direction of a wide web sheet, slitting units mounted, in the number corresponding to the slit number, on the first guide rail so as to be slidingly movable and after positioning thereof, to be locked in place, a transfer mechanism of the slitting units mounted on the second guide rail to be freely movable along the second guide rail so as to position the slitting units to a required position and to enable the dislocking of the slitting units, and a reversibly rotatable lead screw for moving the transfer mechanism, whereby positioning of the slitting units is performed automatically conforming to a slitting width as in ended.

According to this invention, when the narrow web sheets have been wound up on cores located at the lower parts of the core-holding frames in a required diameter, the roll changing for next winding is conducted automatically as follows: First, the core-holding frames are moved to a position above the carriges; the carriages for delivery of full rolls are elevated toward the core-holding frames to support the full rolls on upper faces of the carriages. The full rolls are released from the frames and loaded on the carriages; in that state, the carriages are lowered. Then, the core-holding frames are moved to a position above the core-feeding lifts, and the lifts loading thereon new cores are elevated, during the course of which the new cores abut on narrow web sheets each running from the touch roller to the full roll and whenever necessary, the narrow web sheets are bonded partly to the new cores by an adhesive or pressure-sensitive tape or static electricity. The new cores partly wrapped around with the narrow web sheets are thus supplied to the core-holding frames.

When the core-holding frames holding the new cores are again started to move to cause the new cores to abut on the touch rollers, the cutting equipments cut the narrow web sheets in a width direction. The trailing ends of the narrow web sheets are wrapped around the full rolls whereas the remaining narrow web sheets are wrapped around the new cores, and next winding operation will be commenced.

According to a preferred embodiment of this invention, the roll changing steps for next winding, i.e. the delivery of full rolls and the supply of new cores as described above are performed as follows: When the core-holding frames move to the delivery position of the full rolls, the carrying conveyors for transferring full rolls and the wrapping equipments of the trailing ends are elevated by means of the lifters, and the swing rollers of the wrapping equipments come in contact with the full rolls, simultaneously with which the full rolls are shifted on the swing rollers by detecting signals of the rolls. Upon receiving the full rolls, the lifters are lowered and the core-holding frames are moved toward the core-feeding lift equipments. The core-feeding lifts are elevated toward the core-holding frames to supply them with new cores and then lowered and returned to the initial place. By driving the swing rollers, the narrow web sheets running between the full rolls loaded on the swing rollers and new cores now supplied are tensioned and then the narrow web sheets are cut on the empty cores as a cutting support. The resulting trailing ends of the narrow web sheets are wrapped around the rolls by the rotational driving of the swing rollers, and then, the carriages together with the core-feeding lifts are traveled and moved outside the slitter rewinder machine. On the other hand, the leading ends of the narrow web sheets are wrapped on new cores by actuation of the machine, and next winding is started.

At the position outside the machine where the carriages for delivering full rolls and the core-feeding equipments are now located, the lifters are elevated up to a height of a receptacle or the like on which the full rolls are received and the carrying conveyors are driven to forward the full rolls to the subsequent step. In this way, a series of roll changing operations are finished. The core-feeding equipments, now unoccupied, are supplied with new cores and the carriages are moved into the slitter rewinder machine to be prepared for the next operations for roll changing.

A series of the foregoing operations are performed by sequence control, known per se.

In case where the slitter apparatus comprises the slitting units each having a slitter knife which are slidably engaged with a guide rail and, after positioning, retained in place and the transfer mechanism of the slitting units as described above, it is possible to move the transfer mechanism to a required position conforming to an intended slit width, conforming to which the slitting units are moved to that position and retained in place, thus enabling automatic positioning of the slitting units.

BRIEF DESCRIPTION OF THE DRAWINGS

The preferred embodiments of this invention will be described in more detail with reference to the accompanying drawings, in which.

DESCRIPTION OF THE PREFERRED EMBODIMENTS

Figure 1:
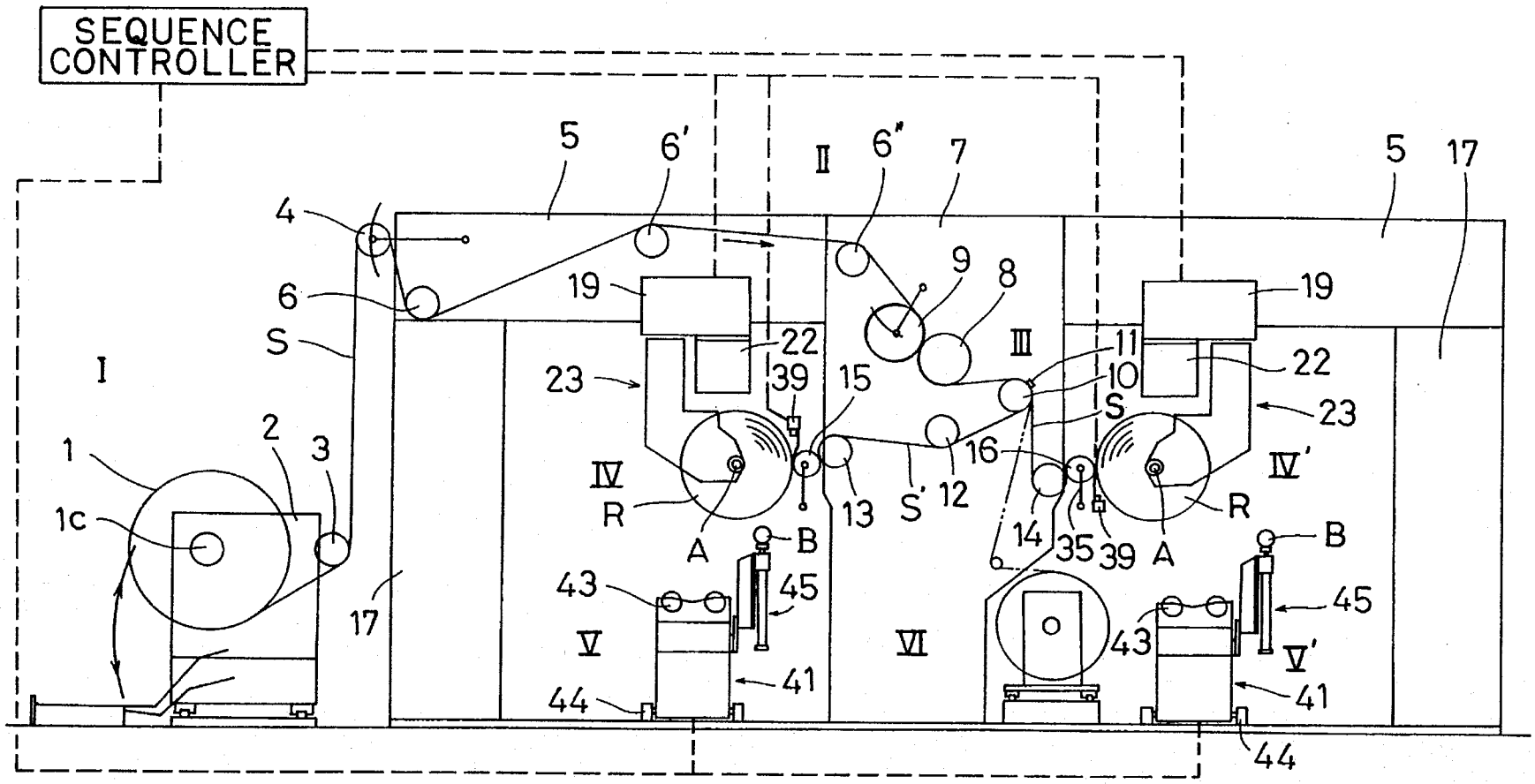
FIG. 1 is a schematic side elevational view showing an example of an automatic slitter rewinder machine of this invention.

Referring to FIG. 1, one example of a slitter rewinder machine comprises generally an unwinder I of a wide web sheet S disposed on the upstream side of the machine; a feed-off apparatus II disposed in the intermediate position of the machine; a slitter apparatus III, for slitting the wide web sheet S into narrow web sheets S', disposed in the intermediate position; winders IV, IV', disposed at upper fore and aft sides of the machine in a suspended manner, or winding up the narrow web sheets S' on cores A; delivery apparatuses V, V', disposed below the winders IV, IV' on the floor, for removing the resulting full rolls from the winders and feeding new cores; and winders VI,VI for winding slit trimmings disposed between the winders IV,IV'.

In the unwinder I, the reference numeral 1 designates an unwind roll of wide web sheet S, whose center core 1*c* is journaled on a reel frame 2 so that center unwinding is conducted.

The wide web sheet S paid out from the unwind roll 1 is directed to run through a guide roller 3 upwardly, passed through a dancer roller 4 and guided by guide rollers 6,6', 6" mounted on an upper frame 5 to reach a take-off roller 8 mounted on a main machine frame 7. The take-off roller 8 serves to take-off the wide web sheet S from the unwinder I while cooperating with a pinch roller 9 to feed it to the winder IV, IV'. To that end, the take-off roller 8 is driven at a desired velocity v with the instrumentality of a variable speed motor (not shown). The velocity v is a reference driving velocity of the slitter rewinder machine.

On the other hand, in the unwinder I, the revolution number n of the larger roll 1 is computed by dividing the driving velocity v by a diameter signal d of the web roll being unwound which signal is detected directly with a detector or a diameter d obtained with a core ratio detector (n=v/d). The unwinder I is driven by means of a unwinding driving motor (not shown), which is controlled by the operated value n as a velocity signal.

In order that the dancer roller 4 located between the unwinder I and the take-off apparatus II can always be retained at a definite position, the dancer roller 4 detects a deviation from the definite position thereby to feed back the deviation signal to a speed control system of the unwinding motor, whereby the unwinder I is ensured to feed the web sheet S at a correct driving velocity v.

The tension force of the wide web sheet S is determined by a dancer load imposed on the dancer roller 4. However, the control of tension force of the sheet S is not limited to this method. Another control method, for example, a method of providing the unwinding shaft 1*c* with a torque-adjustable brake drum is also possible, according to which it is possible to conduct unwinding of the unwind roll 1 to the take-off roller 8 while controlling the brake torque for unwinding at a definite tension.

Here, it is essential that the path of the web sheet S to the take-off apparatus II be located at an upper position of the machine. As a consequence, an open space is ensured in the vicinity of the winders IV, IV' such that the delivery apparatuses V, V' for removal of full rolls and feeding of new cores, which will be later described, can be provided easily.

At a station of the slitter apparatus III, the wide web sheet S is conveyed, encircling around a part of a cylindrical circumferential face of a grooved roller 10 which is grooved at equal intervals in the width direction thereof. Slitter knives 11, e.g. razor knives of the slitter III are thrusted into the grooves of the grooved roller 10 to slit the sheet S into narrow web sheets S'. The razor knives 11 are set in the number conforming to the slit number as intended and at respective positions conforming to the slitting positions.

Alternatively, a shear cutting system including upper and lower blades may also be used, in which the upper and lower blades are rotated in contact state and a web sheet S is passed between the contact parts of the blades to slit it.

In a preferred embodiment, the slitter apparatus III may be provided with an equipment for automatically positioning the slitter knives in conformity with a desired slit width and slit number. The details of the positioning equipment will be later described.

When the wide web sheet S is thus slitted with the slitter III into a plurality of narrow web sheets S', both marginal portions of the sheet S are produced as slit trimmings, which are wound on trimmings winders VI,VI disposed on the floor of the machine, as shown in FIG. 1.

The narrow web sheets S' slitted on the slitter apparatus III are divided alternately on upstream side and downstream side.

The narrow web sheets S' divided on the upstream side are guided through guide rollers 12, 13 mounted on the main machine frame 7 to be encircled from downwardly around the lower circumference of a touch roller 15 by 180° and, while press contacting with a roll R being wound, are wound up thereon, whereas those on the downstream side area guided through a guide roller 14 to be encircled around the upper circumference of a touch roller 16 by 180° and wound up on a roll R being wound.

The winders IV, IV', located on the upstream side and downstream side, respectively, for the narrow web sheets S' led toward the upstream side and for the narrow web sheets S' led toward the downstream side are of the same construction and function and consequently, the one winder IV will be hereinbelow described referring to FIGS. 2 and 3.

Figure 2:
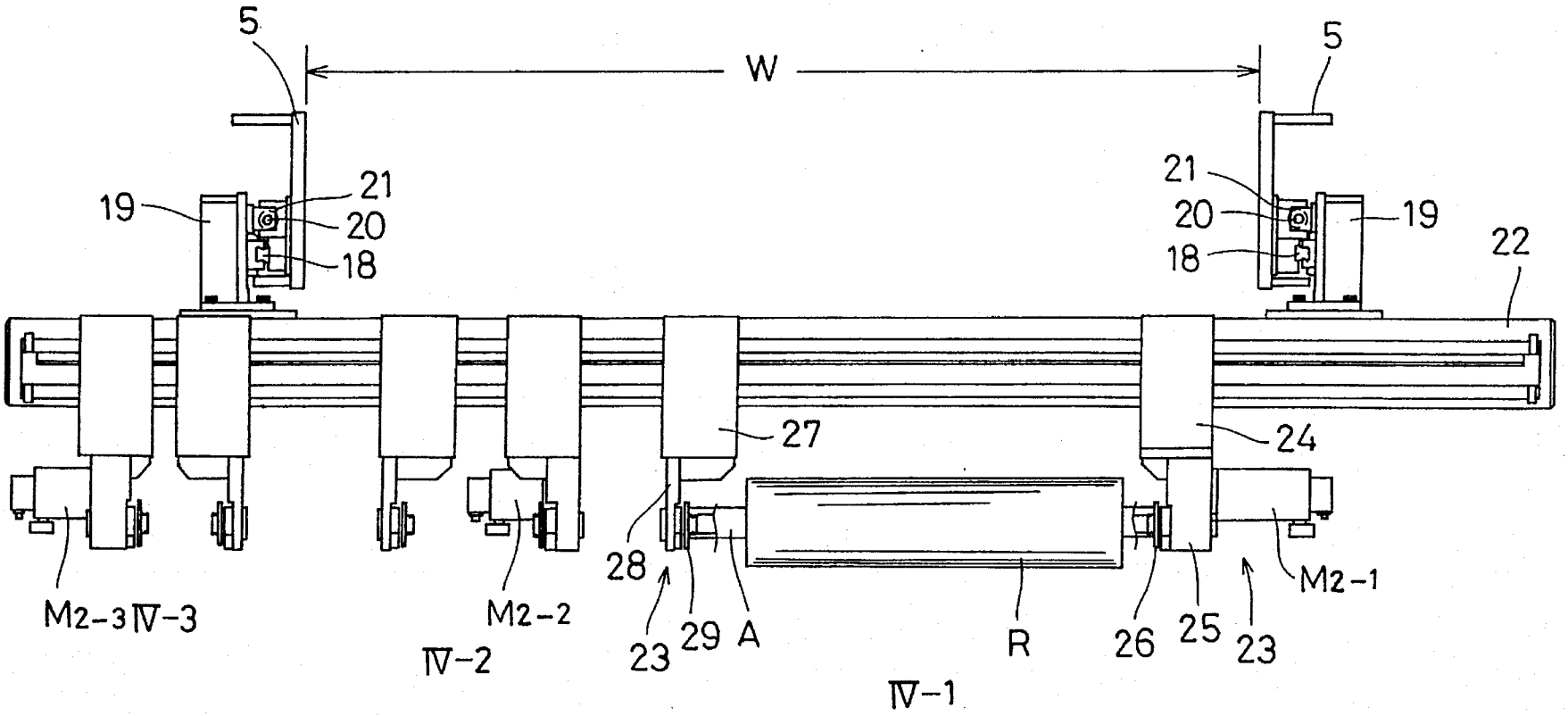
FIG. 2 is a schematic front elevational view showing one example of a winder.
Figure 3:
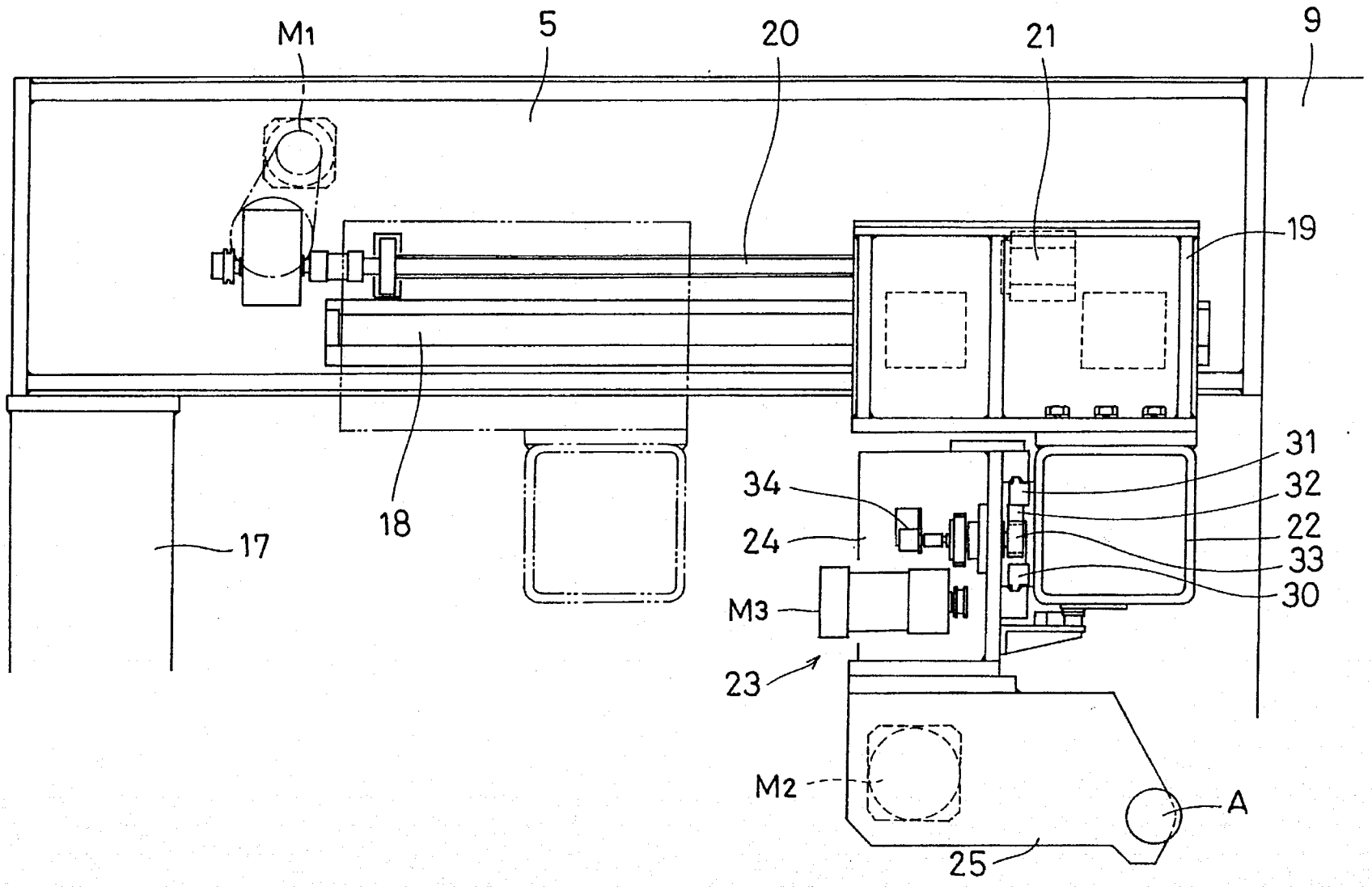
FIG. 3 is a partial schematic side elevational view of a core-holding frame in FIG. 1 showing its details.

At the upper machine frames 5,5 fixed to span the space between the main machine frame 7 and an auxiliary machine frame 17, rails 18, 18 to which mobile members 19, 19 are mounted in engagement are secured so that the mobile members may be slidably movable on the rails (FIG. 2). The mobile members 19,19 are moved back and forth by means of a lead screw device, in which the reference numeral 20 is a lead screw and 21 a nut engaging with the lead screw, the lead screw 20 being revolved reversibly with a motor $M_1$ to move the mobile member 19 back and forth (FIG. 3).

Below the mobile members 19,19, a cross rail 22 is secured to link the mobile members 19,19. By driving the lead screws 20,20 for sliding the mobile members 19,19 by means of the motors $M_1$, $M_1$ and controlling to drive the motors $M_1$, $M_1$ synchronously, the mobile members 19,19 disposed on the right and left and the cross rail 22 are integrally moved toward or away from the touch rollers 15 mounted on the main machine frame 7.

On the cross rail 22, winders IV-1, IV-2, IV-3 in the number of a half the slit number (six slit number in the example in FIG. 2) are provided. Since each of the winders IV-1 to IV-3 is of the same construction, explanation will be made of a representative winder IV-1 (IV).

The winder IV comprises a pair of core-holding frames 23, 23 each including a winding frame 25 or 28 and a slider 24 or 27. A pair of winding frames 25,28 have respectively core chucks 26,29, and the one chuck 26 on the frame 25 is driven with a motor $M_2$, which is operated under control of winding, to transmit the winding torque to a core A which the chuck 26 holds cooperatively with the other chuck 29, thus conducting center winding of one of the narrow web sheets S' dividedly fed.

The winding frame 25 is fastened to the slider 24 at its lower part in a suspended manner, and the slider 24 is in mesh with rails 30,31 fixed to the cross rail 22 so as to be slidably movable in lateral directions along the rails 30,31. A rack 32 is fixed to the rail 31 over its whole length and mates with a rack pinion 33, which is, in turn, rotatably mounted on the slider 24 and driven by means of a motor $M_3$ for setting of winding position, thus enabling the slider 24 to move back and forth by normal or reverse revolution of the motor $M_3$. The other frame 28 is also fastened to the slider 27 having a similar slider drive mechanism to the slider 24 in a suspended manner.

The core-holding frames 23 of the other winders IV-2, IV-3 in FIG. 2 are also engaged with the cross rail 22 to be slidable by means of respective motors $M_{2\text{-}2}$, $M_{2\text{-}3}$, whereby winding positions of the core-holding frames 23 are set to accommodate the positions of the narrow web sheets S' divided led.

In the slider drive mechanism stated above, a rotary encoder 34 is further fitted to enable the reading of respective positions of the slider 24 so that the slider may be set automatically to a position conformed to a cutting position preliminarily input in a computer.

The cross rail 22 extends laterally beyond the width W of the machine as shown in FIG. 2, so that extra winder (IV-3) can be retracted at an overhang part of it. FIG. 2 indicates a position of the winder IV-1 where a wide web sheet S is slit to two narrow web sheets S'. The narrow web sheet S' forwardly led is wound on the winder IV-1 while the other winders IV-2, IV-3 stand by at a non-use part and the left overhang part of the rail 22. On the other hand, the other narrow web sheets S' rearwardly led is wound on a winder IV'-3 corresponding to the rear side of the winder IV-2 and other winders IV'-2, IV'-3 stand by at a non-use part and right overhang part of the rail (all not shown).

In the example of FIG. 2 (two slit number), the breadth of the narrow web sheet is larger and the drive force for winding is inevitably higher, necessitating a large-capacity motor. Consequently, the motor $M_{2\text{-}1}$ of a larger capacity than $M_{2_2}$, $M_{2\text{-}3}$ is fitted to the winder IV-1. The large-capacity motor $M_{2\text{-}1}$, which is of a large size, is disposed at the winding frame 25 on the right side so as not to interfere with the adjacent winder IV-2. For the same reason, the motor for the winder IV'-3 located rearwardly of the winder IV-$_2$ is similarly disposed at the winding frame on the left side of the winder IV'-3.

The constructions of tile unwinder I to the winders IV, IV' have been thus far described, and now the winding operation to rolls will be described.

In FIG. 1, the narrow web sheets S' divided and split are each encircled around the lower circumference of the touch roller 15 by 180° and wound up to a roll R while abutting on the touch roller 15, as described above.

Figure 4:
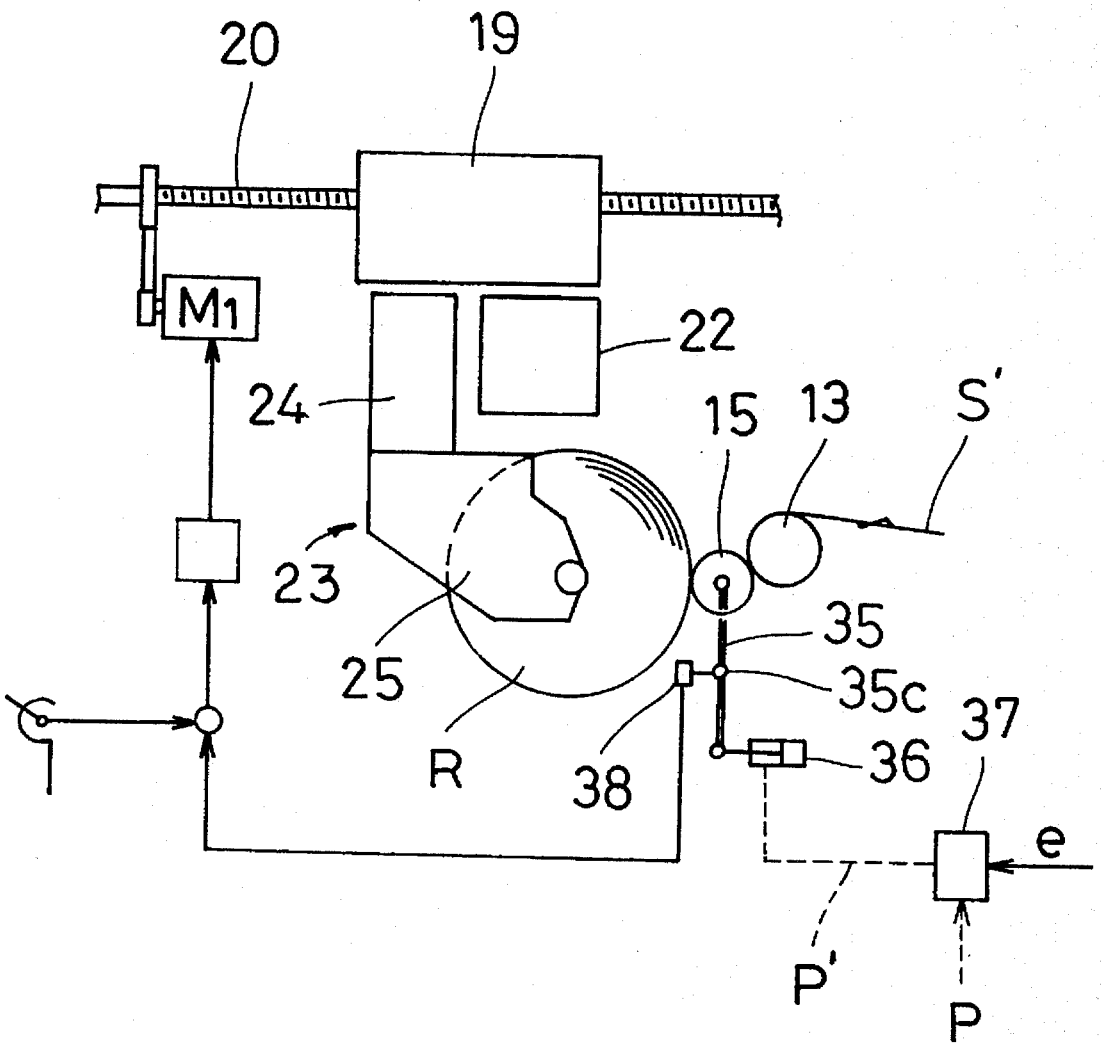
FIG. 4 is a diagrammatic view showing the movement control of a core-holding frame.

The touch roller 15 is, as shown in FIG. 4. rotatably journaled on one end of a touch roller arm 35 which is oscillatable around a rotational center 35*c* and, when the touch roller arm 35 assumes a vertical posture, can press the roll R being wound at its horizontal side, urged by means of an air cylinder 36, which, in turn, sets a contact pressure of the touch roller 15 against the roll R by its pneumatic pressure introduced in the air cylinder. The reference numeral 37 is an electropneumatic converter for setting the pneumatic pressure of the air cylinder 36. When an electric signal input in the electropneumatic converter 37 is e at a pneumatic pressure P of air source introduced, the converter 37 serves to convert the signal e to a pneumatic pressure P' on the basis of computed values of the contact pressure of the touch roller 15 with the roll R which were computed with an arithmetic unit from a definite contact pressure value to a contact pressure value varying depending upon the winding diameter, thereby introducing the pressure P' into the air cylinder 36.

The reference numeral 38 designates a posture detector of the touch roller arm 35 for detecting a slant of the touch roller arm to the vertical posture to feed-back control the motor $M_1$ for the mobile unit 19 so that the detection value may be always zero. As a consequence, the touch roller arm 35 makes pressure contact with the roll R while always retaining the vertical posture and follows the build-up in roll diameter, concurrently with which the mobile unit 19 recedes and consequently, the pair of core-holding frames 23 journaled on the mobile unit 19 in suspended manner retract following the build-up in diameter of roll R. During the winding, since the touch roller 15 always retains the vertical posture, the dead weight of the touch roller 15 and touch roller arm 35 is born and supported on the rotational center 35*c* as a bearing point, and since the narrow web sheets S' directing toward the roll R encircles the lower side of the touch roller 15 by 180°, resultant force of the tension force of the sheet S' is also supported on the bearing point 35*c*. Thus, only the output of the air cylinder 36 acts on the contact pressure of the touch roller 15 on the roll R, and all other indefinite forces exerting on the contact pressure are mechanically excluded, whereby an accurate contact pressure of the touch roller 15 is available.

In case where a plurality of narrow web sheets S' are respectively wound up on a plurality of winders IV (IV-1, IV-2, . . . ), the posture detector 38 for touch rollers 15 is mounted on one of the winders, and its detection signal is representatively applied to a feed-back control circuit, which enables the winders to move following the build-up of roll diameter.

In this manner, winding is performed by reason of the accurate pressure contact of the touch rollers 15 and the control in winding tension of the winding motors $M_2$.

When the narrow web sheets S' are fully wound, delivery of the full-wind rolls, supply of new cores, cutting of the sheets, wrapping of trailing ends of the cut sheets on the full rolls and start of next winding are automatically sequentially conducted. To that end, the delivery apparatuses V, V' for removal of full rolls and supply of new cores are installed. Both apparatuses V,V' are of an identical construction and consequently, the one apparatus V will be described with reference to FIGS. 5–15.

Figure 5:
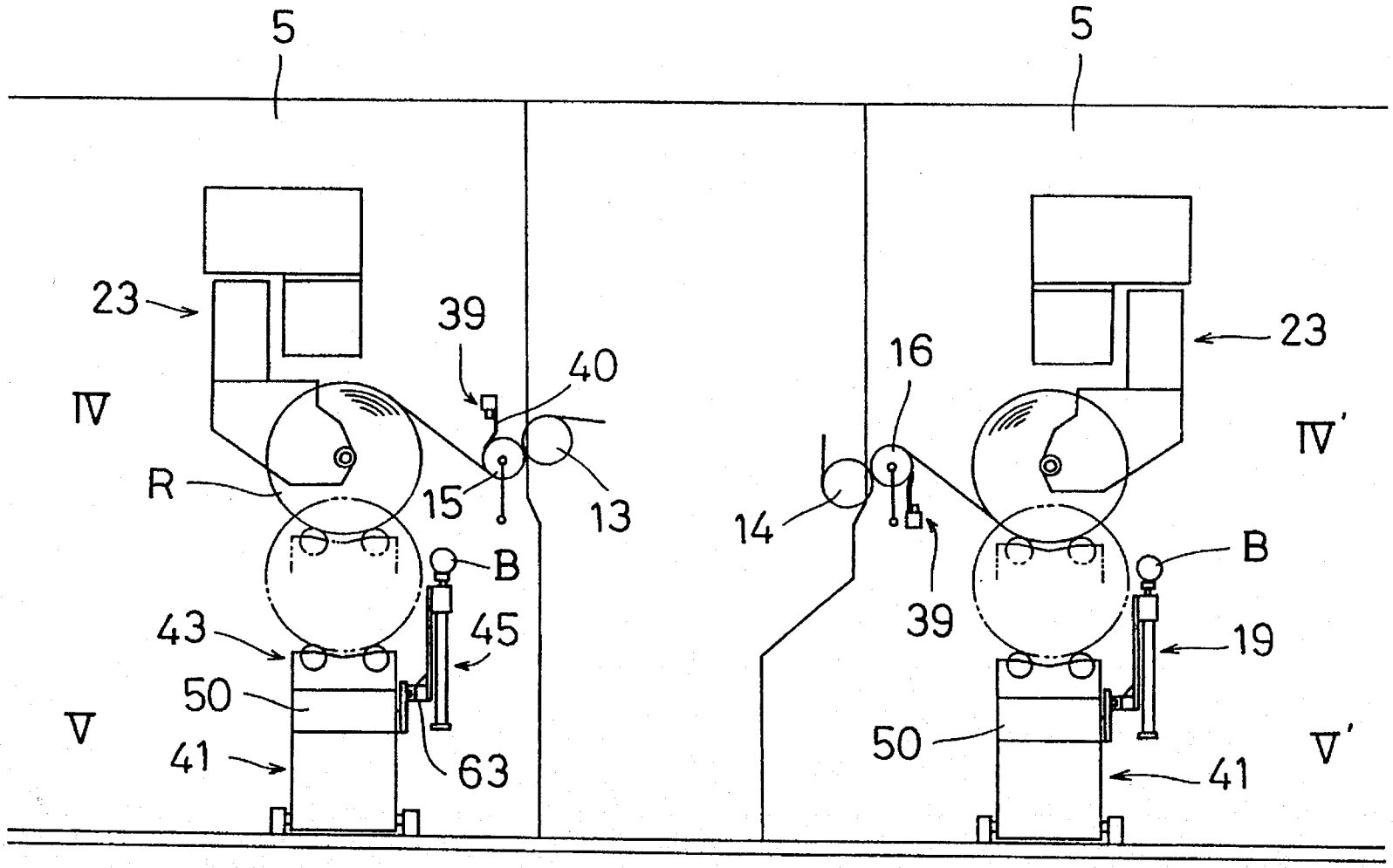
FIG. 5 and FIG. 6 are diagrammatic views showing the steps of roll changing for next winding.
Figure 6:
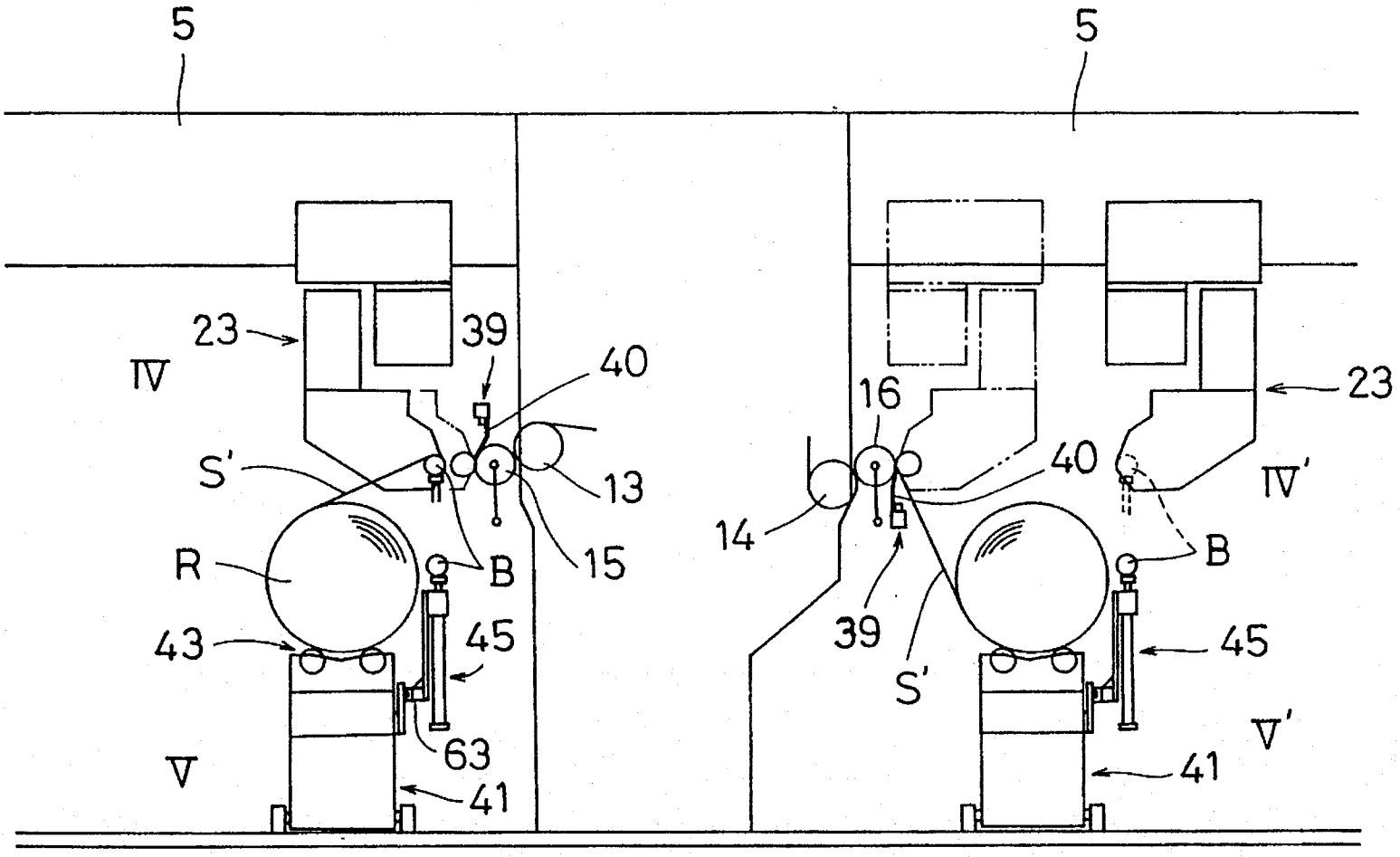

As indicated in FIGS. 5,6 the apparatus V for delivery of full rolls and supply of new cores basically comprises a carriage equipment 41 for removing full rolls out of the core-holding frame pairs 23 to deliver them outside the machine and a lift equipment 45 for supplying the core chuck devices 26,29 of the core-holding frames 23 now in empty state with new cores for next winding. The core-supplying lift 45 is connected to and disposed sideways of the carriage 41. In the neighborhood of the touch rollers 15, cutting equipments 39 equipped with a cutter 40 for cutting the narrow web sheets S' on the full rolls are disposed.

When the narrow web sheets S' are fully wound up on cores A at the lower parts of the core-holding frame pairs 23, first the core-holding frames 23 are moved toward the position above the carriage 41 (FIGS. 5, 6). A lifter 50 of the carriage 41 ascends toward the core-holding frame pairs 23 to support the full rolls R on its upper face. There, the full rolls R are removed from the core-holding frames 23 onto the lifter 50, which descends while riding thereon the rolls R.

Second, the core-holding frames 23 are moved to the position above the core-feeding lift equipment 45, which is then elevated while carrying thereon new cores B. During this elevation, the new cores B abut on the narrow web sheets S' running from the touch rollers 15 to the full rolls R (on the left side of FIG. 6), and if necessary, the narrow web sheets S' are bonded partly to the new cores B with an adhesive or pressure-sensitive tape, or static electricity.

Thus, the new cores B are supplied to the core-holding frame pairs 23 with the narrow web sheets partly wrapped around them. Again, the core-holding frame pairs 23 begin to move to abut the new cores on the touch rollers 15 (two dot-dash lines in FIG. 6). Simultaneously, cutting blades 40 of the cutting equipments 39 cut the narrow web sheets S' in widthwise direction. After cutting of the narrow web sheets S', the trailing ends are wound around the full rolls R whereas the leading ends are wrapped on the new cores B for further next winding.

Figure 7:
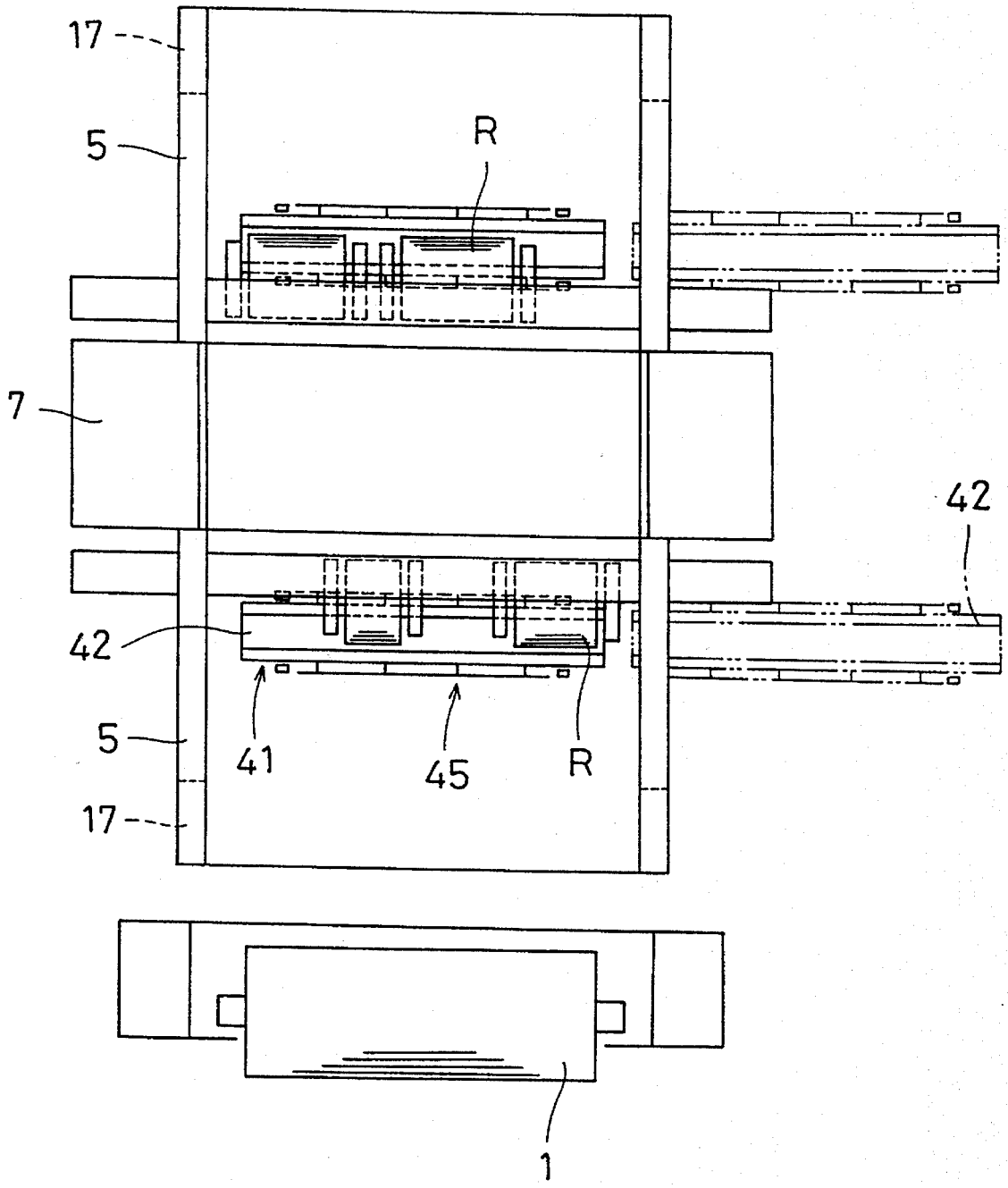
FIG. 7 is a schematic plan view of another example of a slitter rewinder machine partly omitted.
Figure 8:
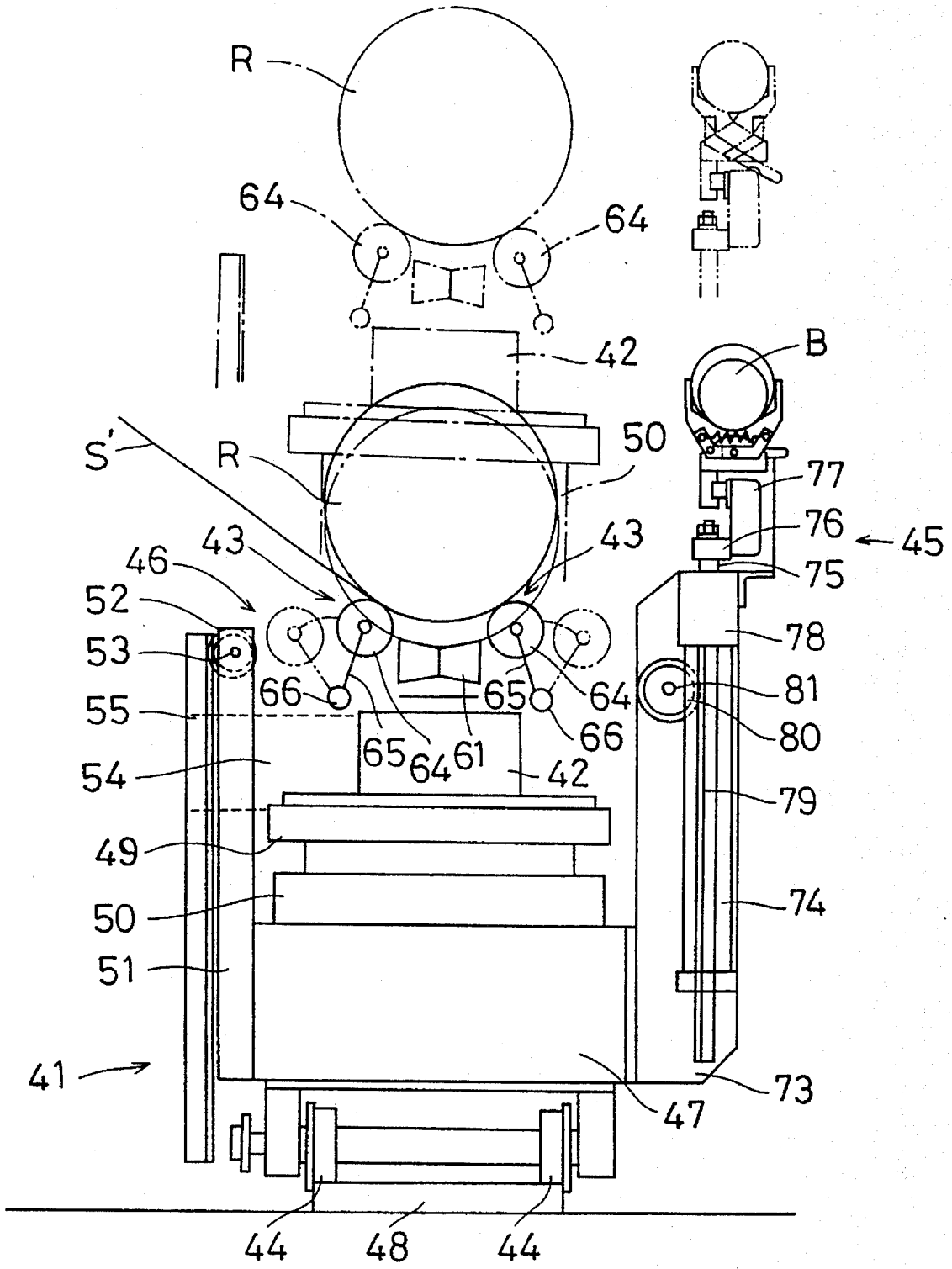
FIG. 8 is a side elevational view of one example of a delivery apparatus including a carriage for removing full rolls and a core-feeding lift.

In a preferred embodiment of the delivery apparatus V, the carriage 41 for delivery of full rolls is provided with a carrying conveyor 42 having a sufficient length required to deposit thereon the full rolls R with the running web sheets S' divided laterally at one time, as illustrated in FIGS. 7,8, whereby all the rolls R can be removed rapidly and efficiently.

However, this invention is not limited to this example, but another means for receiving full rolls may be provided.

FIGS. 8 to 15 show another examples of the apparatus V for delivering full rolls R at one time, wherein the carriage equipment 41 further includes a wrapping equipment 46 for rolling the trailing ends onto the full rolls, and the core-feeding lift equipment 45 includes core-holding devices 84 enabling supplying of a plurality of new cores at one time.

The carriage 41 is fitted, beneath its vehicle body 47, with four wheels 44, which are, in turn, engaged with a rail 48 disposed below the delivery station of full rolls to orthogonally intersect the running direction of the narrow web sheets S', and are driven with a motor (not shown).

Figure 9:
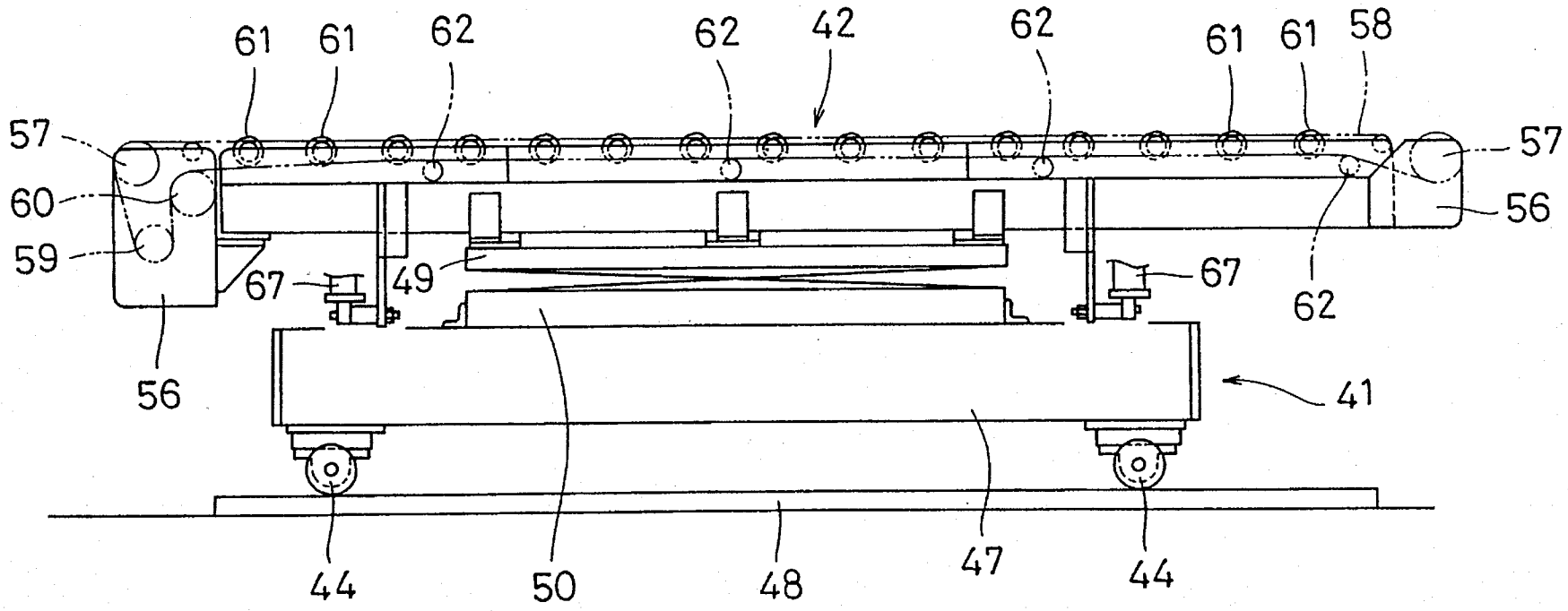
FIG. 9 is a schematic front elevational view showing a carrying conveyor of the carriage in FIG. 8.

The lifter 50 is of a hydraulic table lifter having a lifting table 49, and fixed to the body 47 on its lower face and fitted with the carrying conveyor 42 on its upper face, as shown in FIG. 9.

The carrying conveyor 42 is required to have an enough length to deposit the full rolls R of narrow web sheets S' thereon at one time and is provided with a horizontal level retaining device so that the conveyor will not tilt toward its both marginal sides. That is, on the one hand, two frames 51 are vertically secured to the body 47 at both sides and pivoted rotatably at their tops to respective pinions 52, which are interlinked through a connecting shaft 53. On the other hand, racks 55 mating with the pinions 52 are fastened to the carrying conveyor 42 through a bracket 54. Thus, the conveyor 42 is linked to the connecting shaft 53 through the racks 55 and pinions 52. Consequently, when the carrying conveyor 42 for transferring the full rolls R ascends or descends, the lateral tilting of it is impeded by means of the connecting shaft 53 through the racks 55 and pinions 52, whereby the conveyor 42 can retain always its horizontal position.

Figure 10:
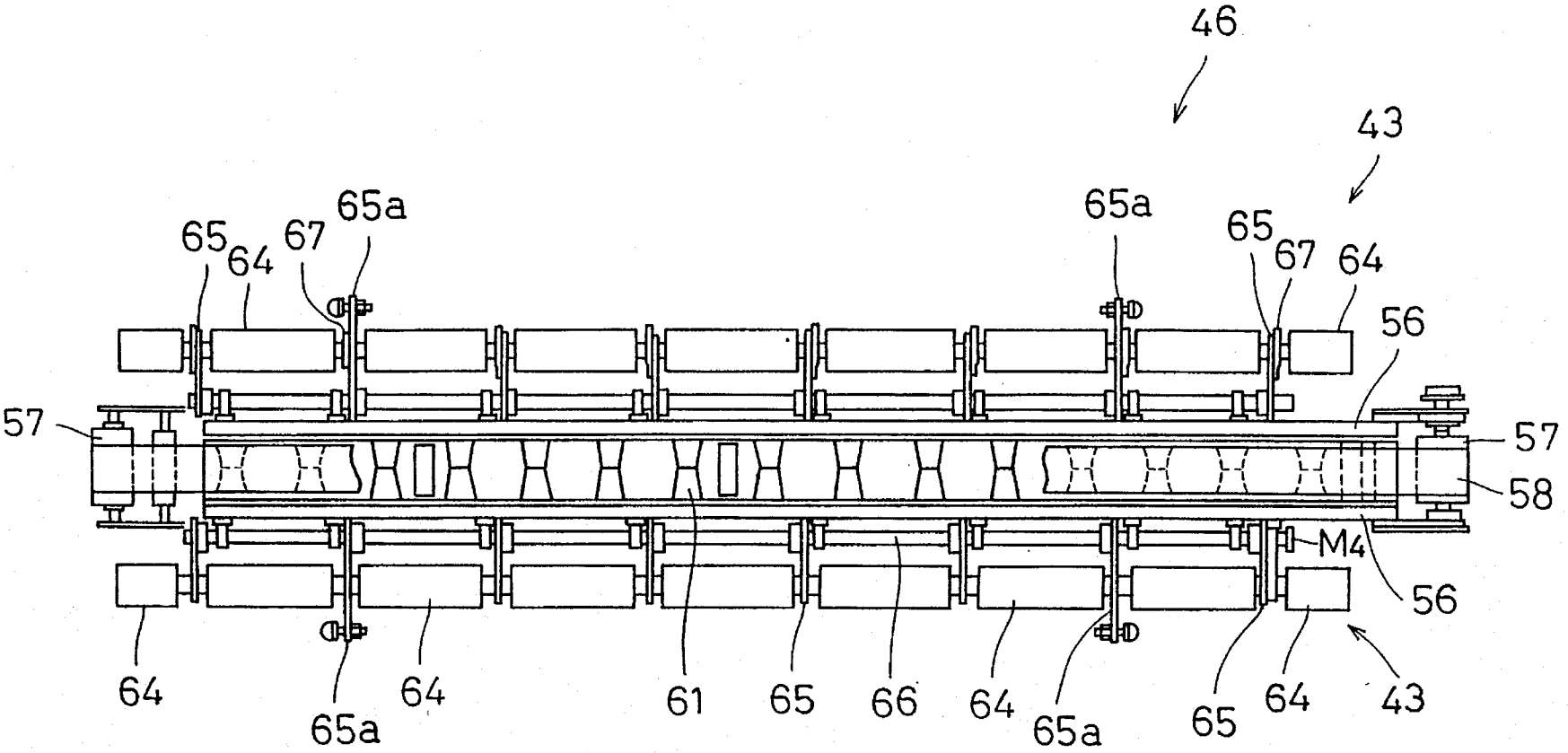
FIG. 10 is a schematic plan view showing a wrapping equipment of the carriage in FIG. 8.

The carrying conveyor 42 is a belt conveyor in the example of FIGS. 9, 10, in which an endless belt 58 is entrained about pulleys 57, 57 pivoted to a pair of frames 56,56 at both sides thereof and is adapted to travel by the rotational driving of the pulleys 57 with the aid of a motor (not shown). In FIGS. 9, 59, 60 designate belt-straining pulleys, 61 designates a plurality of hourglass-shaped rollers supporting the upper side running belt and 62 designates lower rollers for supporting the lower side running belt.

The trailing end-wrapping equipment 46 for full rolls is constructed of swing devices 43,43 disposed alongside of the carrying conveyor 42 at both sides thereof, as shown in FIG. 10. Each of the swinging devices 43,43 is divided into small swing rollers 64 (nine divisions in the indicated example) having a small breadth, the intermediate parts between which are journaled on oscillating arms 65, whose proximal ends are fitted rigidly in an interlocking shaft 66 journaled on the frame 56 of the conveyor 42. Two **65*a*, 65*a* of the oscillating arms 65 of each swing device 43 are linked to air cylinders (partly shown) mounted to the frame 56. By the operation of the air cylinders, the overall swinging devices 43,43 can thus oscillatably move between the two positions shown in solid lines and two dot-dash lines in FIG. 8**.

The swing rollers 64 of the one swing device 43 are driven to rotate by means of a motor $M_4$ whereas the swing rollers 64 of the other swing device 43 are freely rotatable.

The swing rollers 64 of the swing roller device 43 with no motor are each fitted with a device 67 for detecting full rolls (a sensor).

Figure 11:
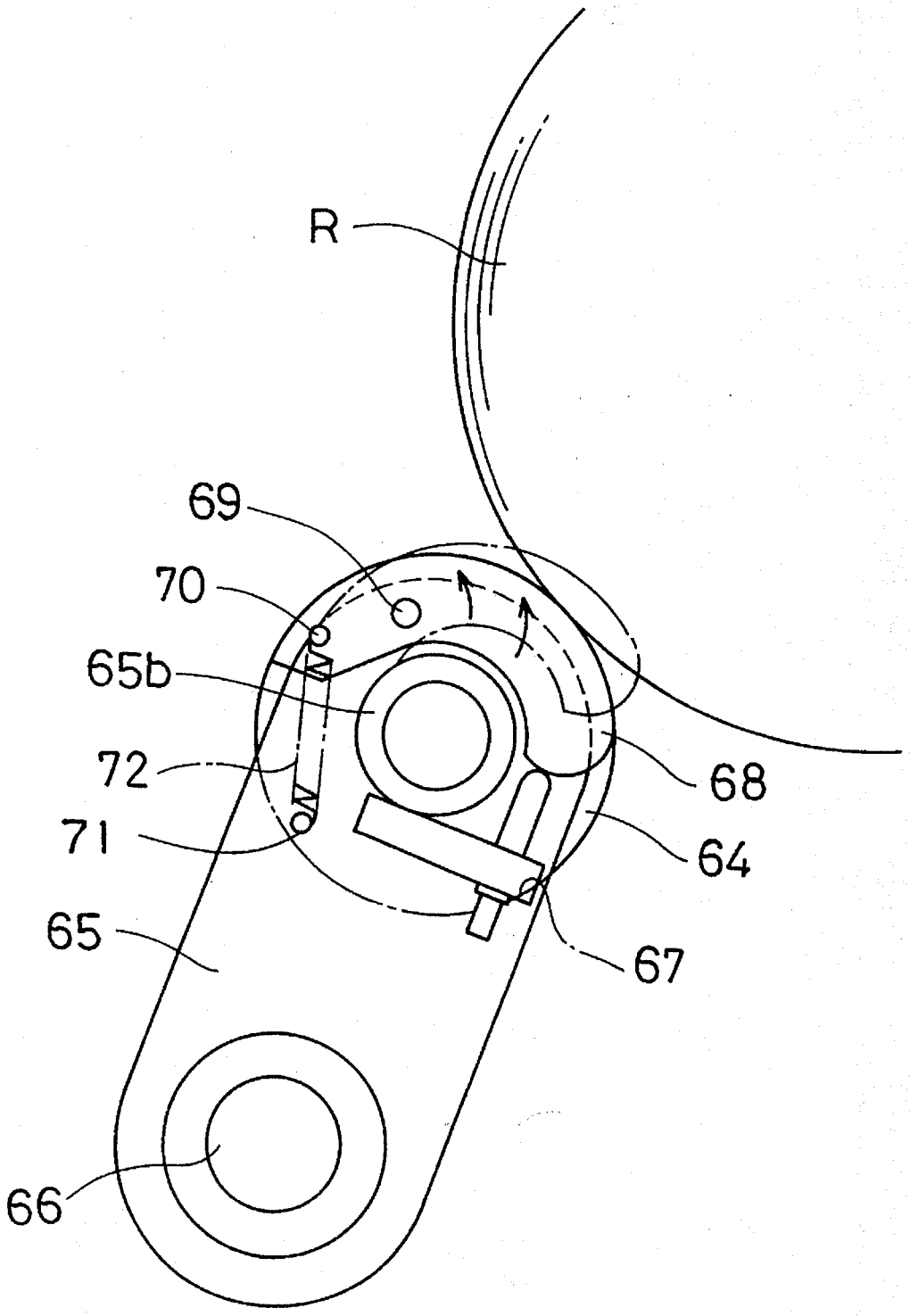
FIG. 11 is a diagrammatic view showing the operation of a sensor for detecting a full roll.

In FIG. 11, the detector 67 for full rolls is illustated. The oscillating arm 65 is fixed, at its end, with a semicircular feeler 68 having the same curvature as that of the outer circumference of the swing roller 64, the feeler 68 being rotatably mounted on a pin 69. Between a pin 70 fixed on the feeler 68 and a pin 71 fixed on the oscillating arm 65, a helical extension spring 72 is hooked so that it can rotate the feeler 68 counterclockwise in the arrow direction by reason of its spring force and at the same time, can impede the rotation of the feeler 68 by its abutting against a projection 65*b* of the oscillating arm 65 at its inner marginal portion, thus allowing the feeler 68 to self-stand at the position more or less outside the outer periphery of swing roller 64, as shown in dot-dash lines.

When the swing rollers 64, 64 are turned to approach together at the position shown in solid lines in FIG. 8 and are brought into abutting on a full roll R in that state, the roll R urges the feeler 68 from the dot-dash line position to the solid line position in FIG. 11, while resisting the extension spring 72, thus causing the distal end of the feeler 68 to act on the sensor 67, whereby the sensor 67 can detect the full roll R.

Figure 12:
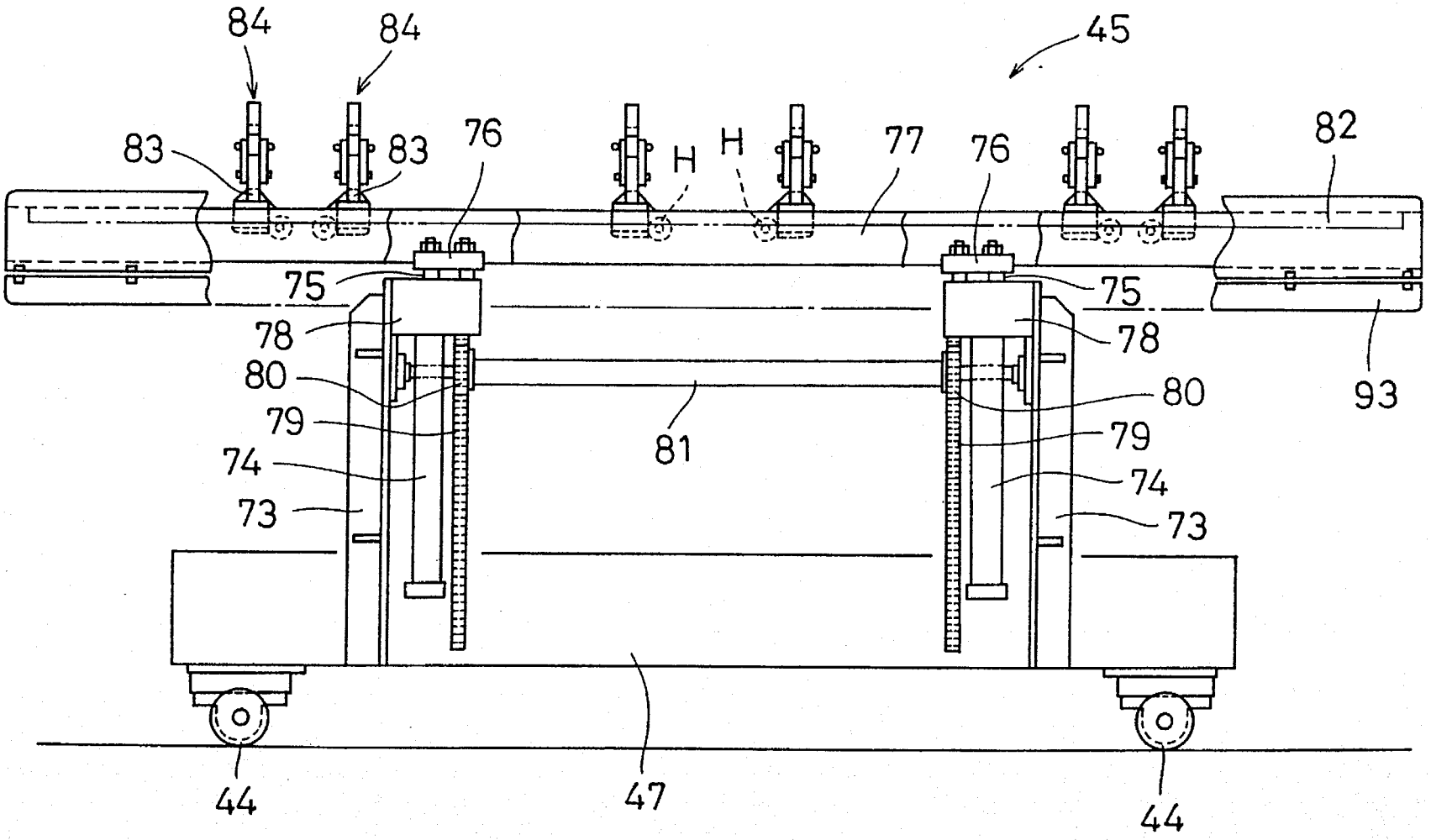
FIG. 12 is a schematic front elevational view showing one example of a core-feeding lift equipment.

The core-feeding equipment 45, which is another essential element of the delivery apparatus V, will be described referring to FIGS. 8, 12.

At both sides of the traveling vehicle 47 there are fixed machine frames 73,73, to which core-feeding air cylinders 74,74 capable of ascending or descending are fastened. Piston rods 75,75 of the air cylinders 74,74 are interlinked with a horizontal member 77 through connecting fittings 76,76 mounted on tops of the rods 75,75, and from the fittings 76,76, racks 79,79 having pinion gears 80,80 are suspended to be guided piercing through end plates 78,78 of the air cylinders 74,74. Both racks 79,79 are coupled through an interlocking shaft 81 meshing with the pinion gears 80,80. The operation of the air cylinders 74,74 is thus synchronized, and consequently, the horizontal member 77 is adapted to ascend or descend, maintaining a horizontal level without tilting.

The horizontal member 77 has a guide rail 82 fastened to a side face of the horizontal member 77 in whole length. The guide rail 82 is fitted engagedly with traveling members or travelers 83 so that they are freely slidable. The travelers 83 are provided in pairs of a number which is equal to the number of winding head of the one winding apparatus IV, to which empty cores are to be supplied (three pairs in the example of FIG. 12), and the position of each pair of the travelers 83 is set beforehand in conformity with each pair of core-holding frames 23.

Figure 13:
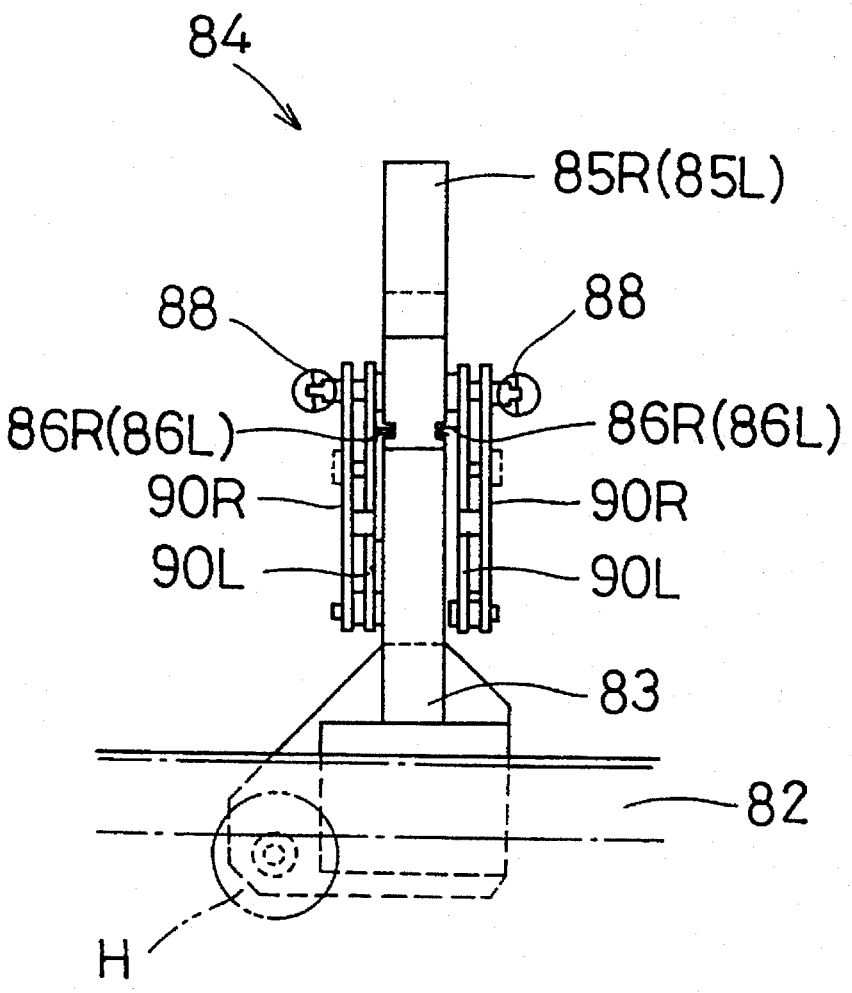
FIG. 13 is a diagrammatic front elevational view showing one example of a core-holding device of the core-feeding lift equipment in FIG. 12.

The position of the travelers 83 in pair is set and held in place by driving a screw rod fitted at its distal end with a brake piece (not shown) having a large friction coefficient with a handle H to thrust the brake piece onto the horizontal member 77. A core-holding device 84 is mounted on each of the travelers 83, as shown in FIGS. 12, 13, 14.

In each of the core-holding devices 84, a pair of core-holding grips 85R,85L are engaged with guides 86R,86L secured to the traveler 83 (FIG. 14*b*) so as to be freely slidable, and pins 87R,87L secured to the core-holding grips 85R,85L are hooked by a helical extension spring 88, whose spring force is caused to act on the core-holding grips 85R, 85L in the direction toward which they approach together, thereby to hold a core therebetween. On the other hand, oscillating arms 90R,90L are mounted rotatably through pins 89R,89L to the traveler 83, and engaged, at one ends thereof, with the pins 87R,87L, and a pin 91 secured to the one oscillating arm 90 R is engaged with an elongated hole 92 of the other oscillating arm 90L (FIG. 14*c*). The other oscillating arm 90L is extended at one end to form a lever 93, which is, in turn, brought into abutment on a butt plate 94 disposed to the end plate 78 of the air cylinder 74 in parallel with the horizontal member 77 (FIG. 14*a*).

Figure 14A:
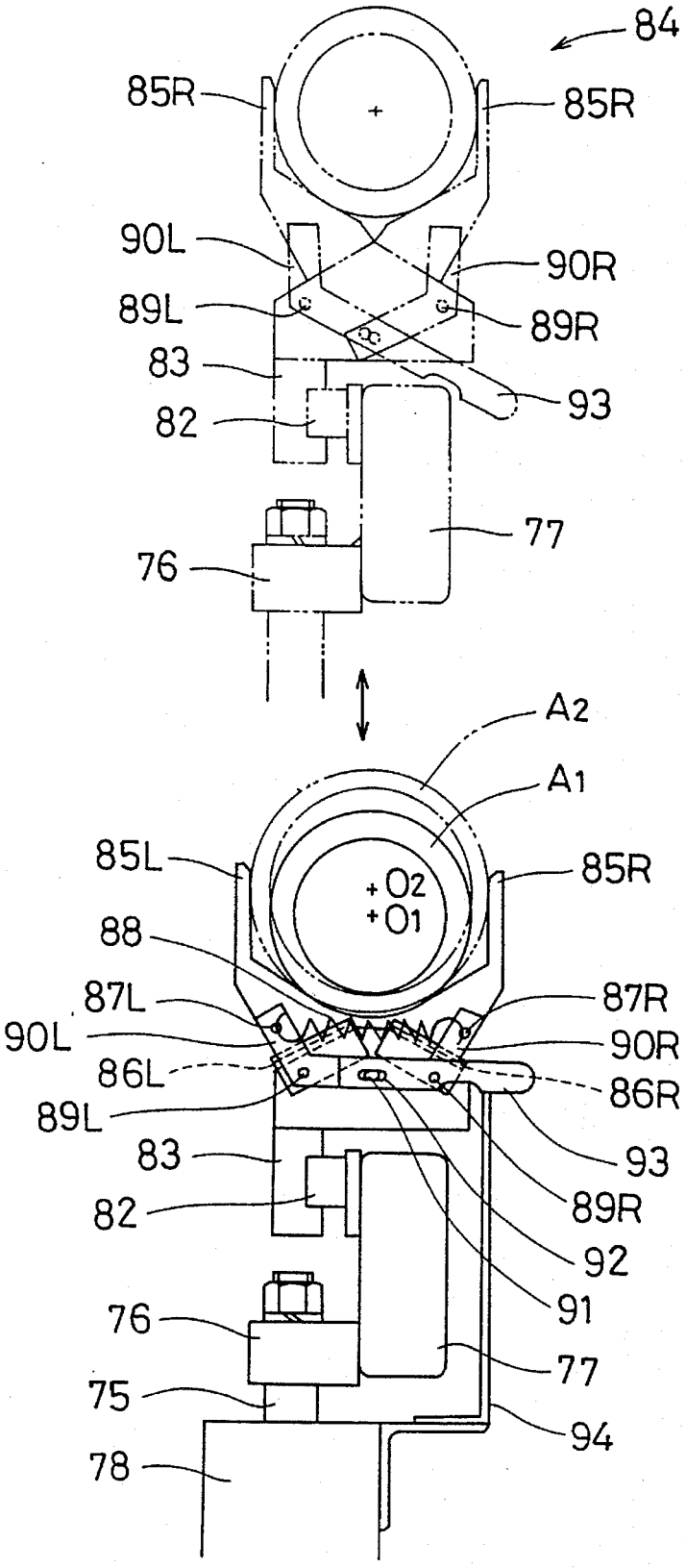
FIG. 14*a* is a diagrammatic side elevational view of the core-holding device in FIG. 13.
Figure 14B:
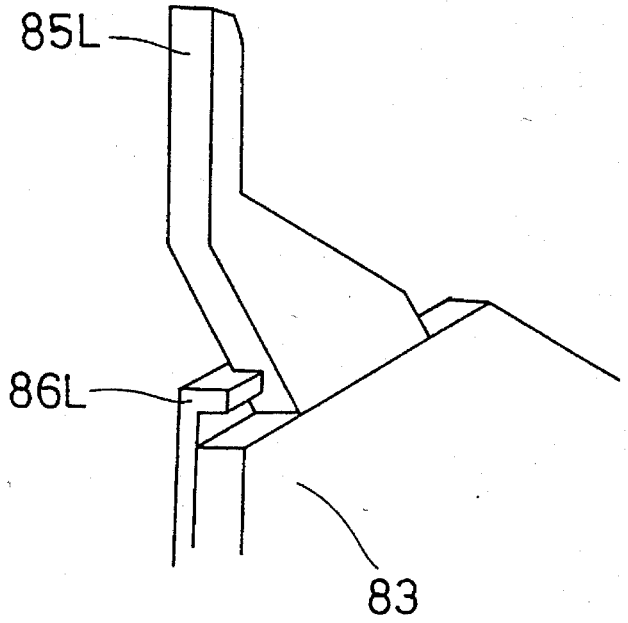
FIGS. 14*b* and 14*c* are each a partial exploded view of the core-holding device in FIG. 13.
Figure 14C:
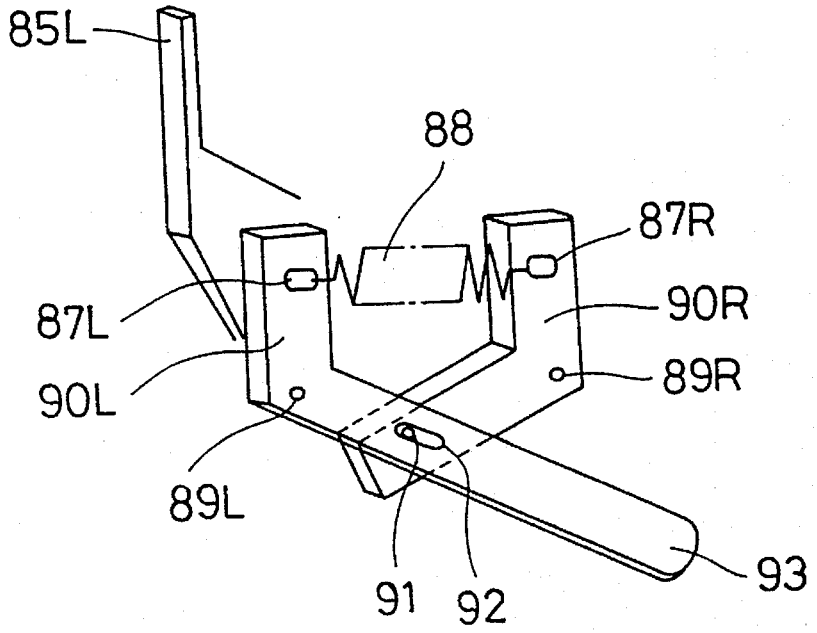

When the oscillating arm 90L is rotated counter-clockwise centering on the pin 89L as shown in the solid lines in FIG. 14*a*, the other oscillating arm 90R is rotated clockwise through the elongated hole 92 and pin 91, as a result of which the core-holding grips 85R,85L are moved away from each other, urging the spring 88. This action takes place when the piston rods 75,75 of the air cylinders 74,74 are moved into the cyclinders. When the piston rods 75,75 are moved out of the cylinders, the lever 93 is released from the abutment state on the butt plate 94, and the oscillating arm 90L and the oscillating arm 90R are rotated clockwise and counterclockwise, respectively, by the spring force of the spring 88. As a consequece, the core-holding grips 85R, 85L are moved toward each other along the guides 86R,86L, thus cooperatively grasping a core.

If the core-mounting base of the core-holding device 84 has a fixed trough shape on its inner face, when cores of different outside diameters are loaded on it, their heights of center are different. As shown in FIG. 14*a*, a core $A_1$ of a small diameter has a lower center position $O_1$ and a core $A_2$ of a large diameter has a higher center position $0_2$. If the different cores $A_1$, $A_2$ are supplied to the core chucks 26, 29 of a winding head in that state, the operation of the chucks will be inconvenienced. Therefore, in order that the center position of every core, irrespective of different outside diameters, may always be unchanged and the operation of core chucks may not be impaired, namely, self-aligning property may be obtained, the guides 86R,86L are provided at the core-holding device 84.

Figure 15:
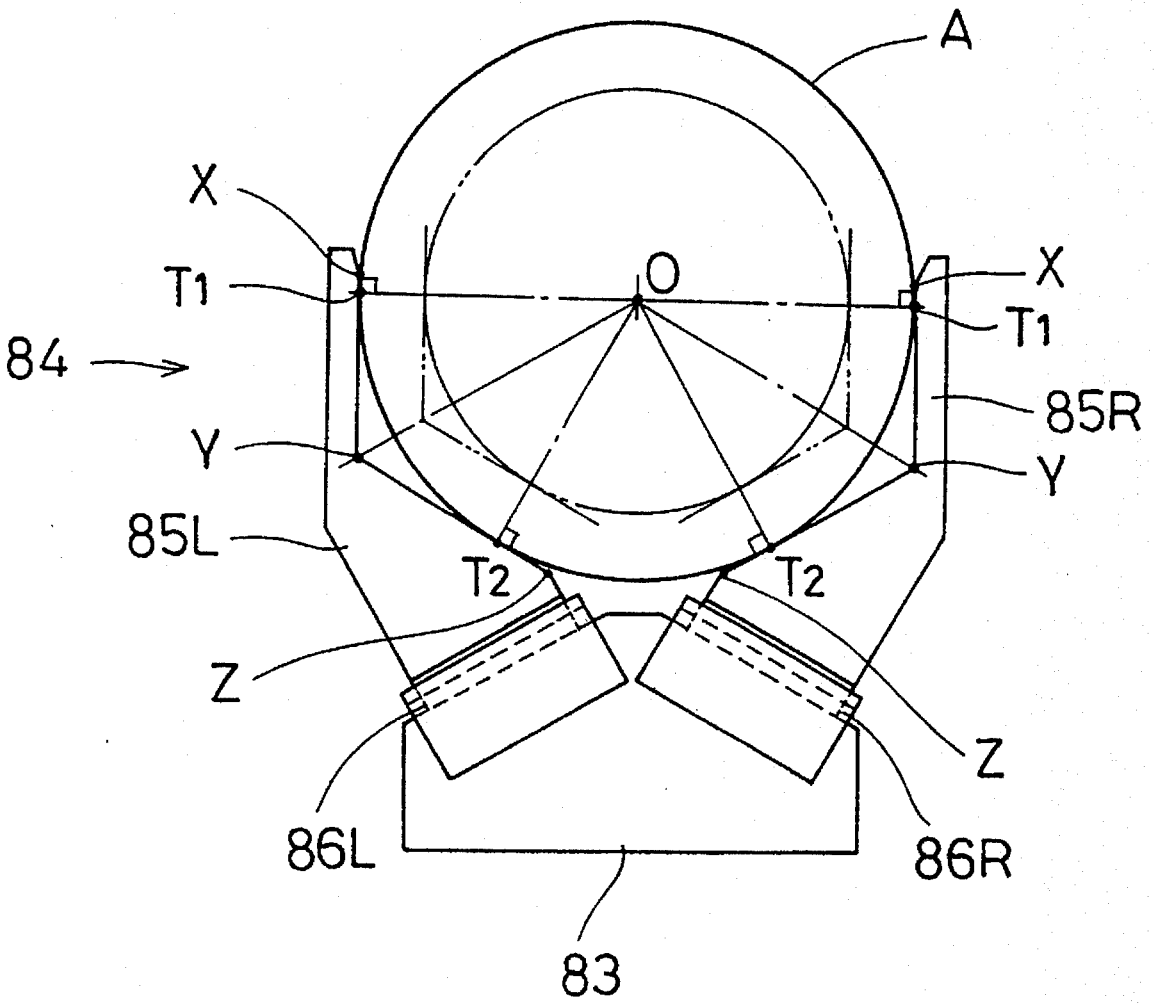
FIG. 15 is an illustrative representation showing the self-aligning principle of the core-holding device in FIGS. 13 and 14*a;*

The self-aligning property of the guides 86R,86L will be explained with reference to FIG. 15. Supposing a core A is mounted on the core-holding grips 85R,85L assuming each a folded line profile of XYZ, the core has a tangent point $T_1$ between the outer periphery of the core and line XY and a tangent point $T_2$ between the outer periphery of the core and line YZ; and a perpendicular line of $T_1$ to the line XY and a perpendicular line of $T_2$ to the line YZ intersect at O, which is a center point of the core A.

If the core-holding grips 85R,85L are shifted in parallel along the line YO, then cores of any outside diameter that are internally tangent to the core-holding grips 85R,85L have the center point O. The guides 86R,86L are fitted in parallel with the line YO. Consequently, when the core-holding grips 85R,85L are slidingly moved along the guides 86R,86L, cores of any outside diameter internally tangent to the core-holding grips 85R,85L have all the same center point O. When both the core-holding grips 85R,85L are moved toward each other by urging of the spring force of the spring 88, the center position of cores can be made always constant. Thus the core-holding device 84 having a self-aligning property is obtained.

The operation of the delivery apparatus V, namely, the delivery carriage 41 including the conveyor 42 and wrapping equipment 46 and the core-feeding equipment 45 including the core-holding devices 84 will be described. Naturally, the operation and construction of the other delivery apparatus V' are identical to those of the apparatus V, and the explanation thereof therefore will be omitted.

When the narrow web sheets S' are fully wound, pairs of the core-holding frames 23 are moved toward the station for delivery of full rolls R while the swing rollers 64,64 of the trailing ends-wrapping equipment 46 located below the station are approached together at the position shown in the solid lines in FIG. 8, and the carrying conveyor 42 and the wrapping equipment 46 of trailing ends are elevated by means of the lifter 50.

The moment that the swing rollers 64,64 are elevated to abut on the full rolls R(the position of dot-dash lines in FIG.

8), the full rolls each press the feeler 68 down and the sensor 67 detects each roll as shown in the solid lines in FIG. 11. By the detecting signal the lifter 50 stops ascending, concurrently with which the chucks 26,29 for holding cores are released to transfer the full rolls onto the swing rollers 64,64. After receiving the rolls R the lifter 50 is lowered and simultaneously, the core-holding frames 23 are moved toward the core-feeding equipment 45. Holding new cores B, the core-feeding equipment 45 is elevated toward the winder IV (the position of dot-dash lines in FIG. 8) to feed the winder with the new cores, and then lowered and returned to the initial position. Next, by actuating the swing rollers 64 (on the motor $M_4$ side), the webs S' extending between the full rolls R loaded on the swing rollers 64,64 and new cores B now supplied are tensioned and subsequently, cut with the traveling knives 40 of the cutting equipments 39 on the empty cores as a cutting support. The free cut ends of the webs S' are wrapped around the rolls R by the rotational actuation of the swing rollers 64. Subsequently to the wrapping, the swing rollers 64,64 are turned to be moved away from each other (two dot-dash lines in FIG. 8), and the full rolls are loaded on the carrying conveyor 42. Then, the carriage 41 is traveled and the overall apparatus V is moved outside the slitter rewinder machine. The other leading ends of the web sheets S' are wrapped around the new cores B for next winding by the actuation of the slitter rewinder machine. At that time, the leading ends are bonded to the cores by an adhesive or a pressure-sensitive tape, or static electricity.

In the delivery apparatus V for removal of full rolls and supply of new cores thus moved outside, the lifter 50 is elevated to a height of a reservoir or the like for receiving thereon the full rolls, which are transferred on the carrying coveyor 42 in sequence to a subsequent step. A series of the operations for delivery of full rolls and supply of new cores are finished in this way.

The core-feeding lift equipment 45 now unoccupied is supplied with empty cores B and the carriage 41 is traveled inside the machine to stand by for next working.

A series of the operations as described above are performed by a sequence controller 200 (FIG. 1) known per se.

Upon slitting, the slit width of the wide web sheet S is usually beforehand set to a definite value as desired, but, as the case may be, may be changed during operation. This change of setting can be made by manual operation, or more preferably, by automatic operation, as hereinafter described.

A preferred embodiment of the slitter apparatus III is shown in FIGS. 16 to 20, according to which when the slit width of the web sheet S is changed, the slitter knives 11 can be automatically positioned in conformity with the slit width changed.

The slitter III comprises, as main elements, slitting units 101 having the knives 11 and a transfer mechanism 102 for moving and positioning the knives in conformity with the slit width.

Figure 16:
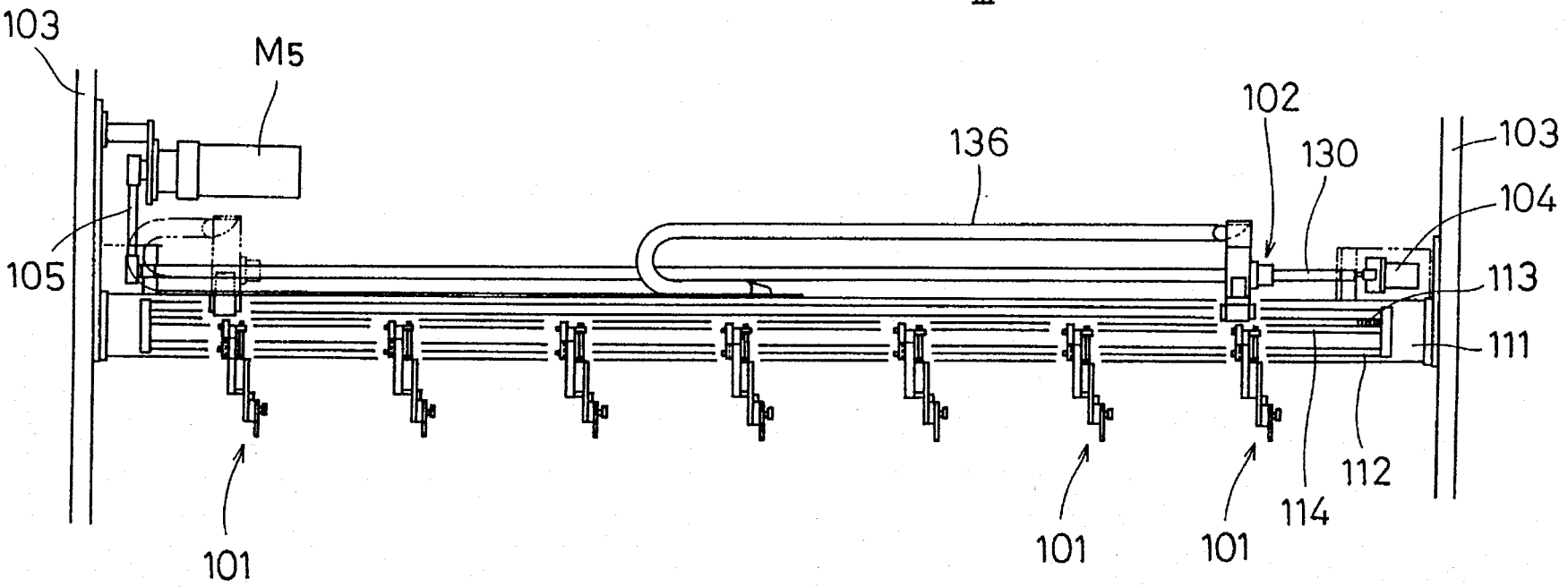
FIG. 16 is a schematic front elevational view of one example of a slitter apparatus showing slitting units and a transfer mechanism thereof.

Referring to FIG. 16, a lateral member 111 is disposed to span machine frames 103,103, and to one lateral side of the lateral member 111, a first guide rail 112 and a second guide rail 113 are fixed to interpose a rack 114 for locking the position of the slitting units 101 therebetween. The first guide rail 112 is slidably engaged with a plurality of slitting units 101 whereas the second guide rail 113 is mounted through a traveling member 128 (FIG. 17) to the transfer mechanism 102 for moving the slitting units 101 so that the transfer mechanism can travel.

Figure 17:
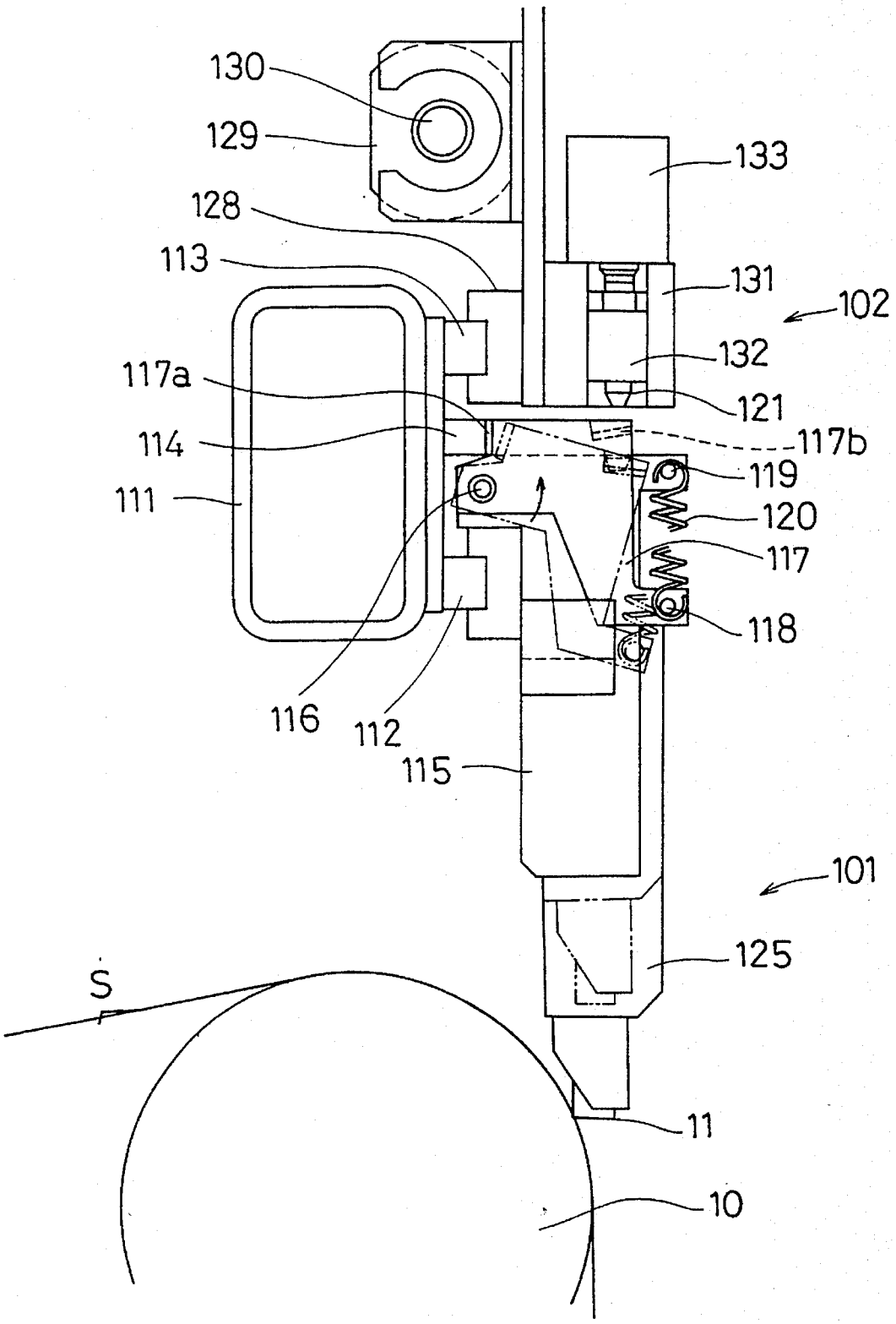
FIG. 17 is a partial schematic side elevational view of the slitter in FIG. 16.
Figure 18:
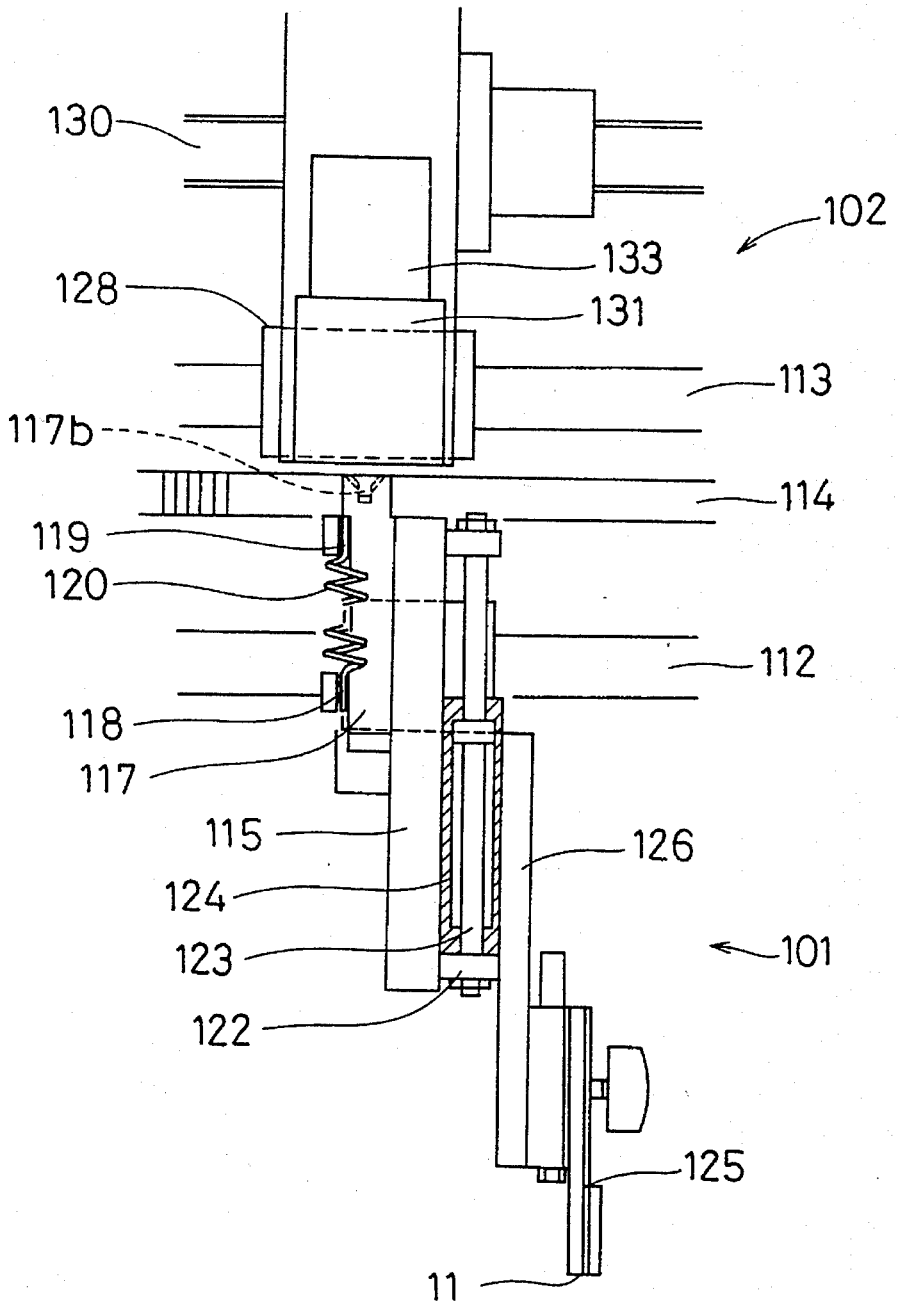
FIG. 18 is a schematic front elevational view, partly enlarged, of the slitter in FIG. 16.

In each slitting unit 101 shown in FIGS. 17, 18, a slider 115 is engaged with the first guide rail 112 to be slidably movable; a lock fitting 117 for locking the slider 115 in place is fastened to the sliding member 115 through a pin 116 rotatably pivoted thereon; between a pin 118 fixed to the lock fitting 117 and a pin 119 secured to the slider member 115, an extension spring 120 is hooked and spanned to urge the lock fitting 117 counterclockwise as shown in the arrow by the spring force, thus engaging the one end **117*a* of the lock fitting 117 with the rack 114 whereby the slider member 115** is locked and held in place.

The lock fitting 117 is formed at its top with a recess **117*b*, with which a protrusion 121 of the transfer mechanism 102 is engageable. The slider 115 is fitted with an air cylinder 122, whose piston rod 123 is fixed to the slider so that a cylinder 124 may reciprocate on the piston rod 123. To the cylinder 124 is mounted a knife board 126, to which a knife cartridge 125 is secured so that the knife blade 11** can be readily exchanged.

The transfer mechanism 102 for moving the slitting units 101 is constructed so that the traveling member 128 is engaged with the second guide rail 113 so as to be slidably movable and a female screw 129 is mounted on the traveling member 128 so as to hinder the rotation and movement in the axis direction of the screw 129 and engaged with a lead screw 130 rotating reversibly. By normal and reverse rotation of the lead screw 130, the traveling member 128 can thus be moved on the second guide rail 113 in the right and left directions in FIG. 18.

The lead screw 130 is mounted in parallel with the lateral member 111 between the frames 103,103 and connected at its one end to a motor $M_5$ through a transmission gear 105 and at its other end to a detector of revolution number, e.g. a revolution encoder 104 (FIG. 16).

The traveling member 128 is secured, at the opposite side to the second guide rail 113, with a lifting guide 131, in a hole of which a lifting rod 132 having the protrusion 121 is connected to an air cylinder 133 at a top of the lifting guide 131 so that the protrusion 121 can protrude from or retreat in the lifting guide 131 by the actuation of the air cylinder 133. When the protrusion 121 protrudes, it fits into the recess **117*b* (dash lines in FIG. 17) of the lock fitting 117, which action rotates the lock fitting 117 about the pin 116 against the spring 120 to disengage the end 117*a* from the rack 114 (two dot-dash lied in FIG. 17), thereby making the travel of the slitting units 101 free and simultaneously transmitting the travel of the transfer mechanism 102 by the revolution of the lead screw 130 to the slitting units 101 through the protrusion 121 and moving the slitting units 101 along the first guide rail 112**.

The protrusion 121 is configured at its top end as a reverse truncated cone shape and the recess **117*b* is chamfered (FIG. 18) so that the gradient of the truncated cone is in agreement with tile chamfer gradient, and consequently, when the protrusion 121 is plugged into the recess 117*b***, both can be snugly fitted without causing back-lash, thus never causing any displacement error.

By the same token, the end **117*a* of the lock fitting 117 is chamfered to conform to the toothed face angle of the rack 114 with which the end is engaged and configured as a trapezoid in sectional contour, so that when the lock fitting 117 is engaged with the rack 114**, the fitting can be securely retained in place without causing backlash.

Figure 19:
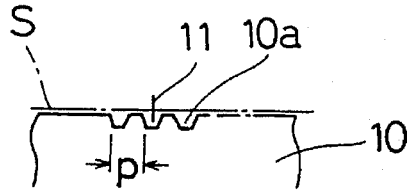
FIG. 19 is an illustration showing a slitting method.

In the example of slitter apparatus III as described above, the knife blade 11 of each slitting unit 101 is adapted to be thrusted into ring grooves **10*a*, located at regular intervals, of the grooved roller 10 on which the wide web sheet S runs as shown in FIG. 19, thereby performing slitting. Because of this, the rack 114 having the same pitch as a groove pitch p is fastened to the lateral member 111 to conform to the phase of groove pitch of the grooved roller 10**.

In case of on air slitting method, the slitter apparatus III dispenses with such a rack 114 as described above and can be constructed so that a material having a large friction coefficient is fastened to the end 117*a* of the fitting 117 and abutted on a smooth face instead of the rack 114, whereby the lock fitting 117 is held in place by friction force.

Compressed air source for operating the air cylinders 122,133 for the slitting units 101 and the transfer mechanism therefor will be described.

Figure 20:
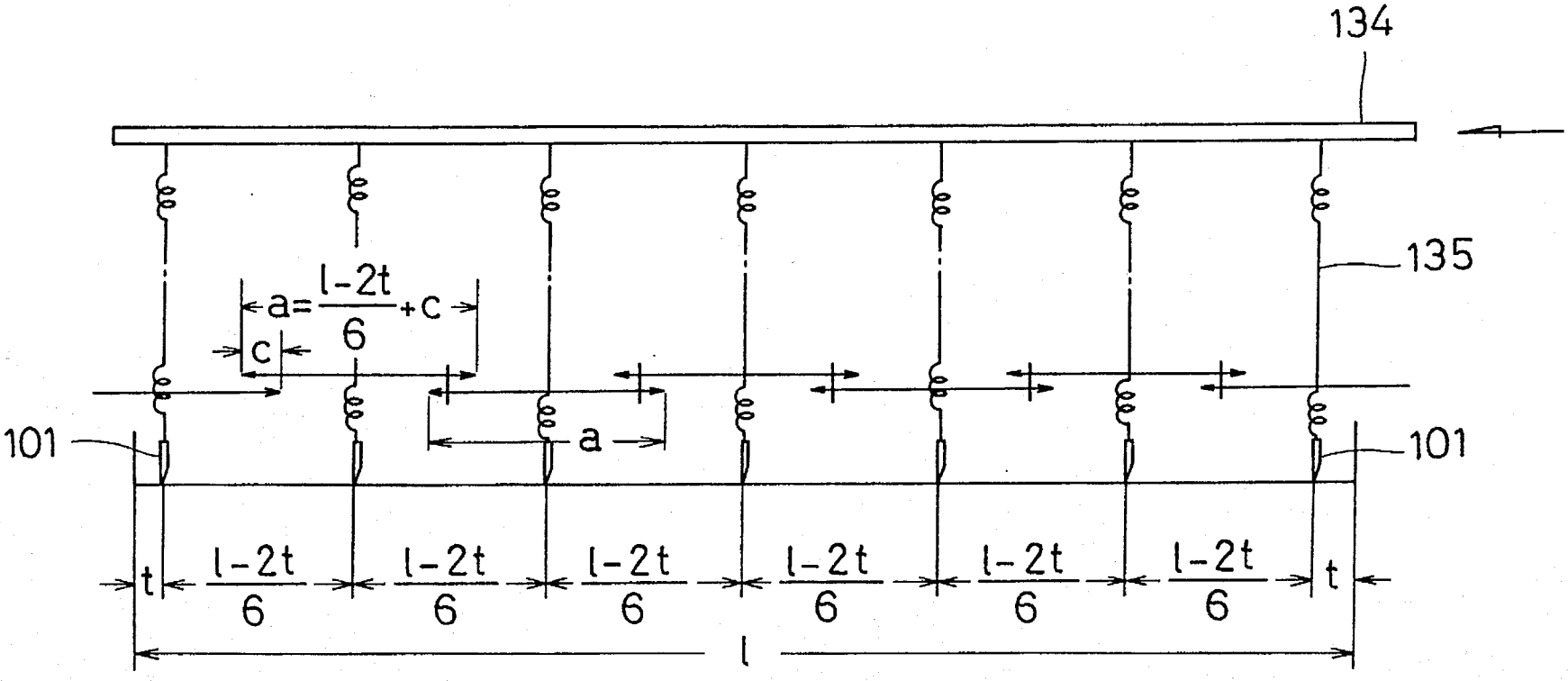
FIG. 20 is an illustration showing the movable scope of each slitting unit.

An example of six slitting is indicated in FIG. 20, in which supposing that the whole length of the wide web sheet S is 1, the width of trimmings is, the lapping range of adjacent slitting units is, the movable range a of one slitting unit 101 is expressed by:

$$\underline{a}=\frac{\underline{l}-2\underline{t}}{6}+\underline{c}$$

In general, case of n slitting, $$\underline{a}=\frac{\underline{l}-2\underline{t}}{\underline{n}}+\underline{c},$$

and the movable range is thus relatively small. Consequently, respective slitting units 101 are connected through flexible tubes such as coil tubes 135 to a manifold tube 134 into which compressed air is introduced from a compressed air source.

By determining the movable range of the slitting units 101 as described above, slitting is enabled with any slitting unit at any position over the whole widthwise length of the web sheet.

When the slitting width is determined in a slitting number less than the given number, knife bases 126 of extra slitting units 101 are elevated by the actuation of the air cylinder 122 and allowed to be distant from the web sheet S.

For the introduction of compressed air into the transfer mechanism 102 of slitting units, the transfer mechanism must move and travel in the whole widthwise length of the web sheet S. To that end, a cable bearer 136 known per se is mounted to the transfer mechanism 102 as indicated in FIG. 16, and a flexible air tube (not shown) connected to compressed air source is laid along the cable bearer 136 so that the flexible tube is connected through the head of traveling member 128 of the mechanism 102 to the air cylinder 133.

The automatic positioning with the transfer mechanism 102 of slitting units 101 can be performed on the basis of a program set in conformity with the slitting number and slitting width as required by controlling the rotational direction and revolution number of the lead screw 130.

According to the slitter rewinder machine of this invention thus far described, after full winding, it is possible to remove full rolls at one time, to supply new cores at one time, and immediately thereafter, to move the delivery apparatuses outside the machine to transfer the full rolls to a next step, whereby a series of roll changing steps can be automatically conducted. As a consequence,next winding operation can be resumed promptly after the removal of full rolls and supply of new cores, which reduces significantly the winding downtime due to the transitional roll changing works for next winding. Therefore, the overall operation of winding can be automatized, thereby increasing the production efficiency on the slitter rewinder machine.

What is claimed is:

1. A slitter rewinder for receiving a continuous length, elongated width sheet of web material and forming core-center rolls of the web material, said slitter rewinder assembly including:

a feed assembly for receiving the elongated width web sheet and transporting the elongated width web sheet in a feeding direction;

a slitting assembly positioned to receive the elongated web sheet from said feed assembly, said slitting assembly being positioned to extend across the width of the elongated width web sheet and having at least one slitter knife positioned for cutting the elongated width web sheet into a plurality of narrow width web sheets;

two roll forming assemblies, said roll forming assemblies being located on opposed sides of said slitting assembly for each receiving at least one narrow width web sheet therefrom, each said roll forming assembly including:

a support frame having elevated support rails that extend from a position proximal to said slitting assembly to a position distal from said slitting assembly;

a cross rail assembly including a cross rail attached to said support frame rails to move along said support rails and a drive unit connected to said cross rail to move said cross rail along said support rails;

at least one core holding assembly suspended from said cross rail, said core holding assembly including: two core holding frames mounted to said cross rail to move along said cross rail, said core holding frames being configured to rotatably support a core therebetween; a drive mechanism for moving said core holding frames along said cross rail; and a core-driving motor attached to one said core holding frame for rotating the core supported by said core holding assembly so as to wrap the narrow web sheet around the core so as to form a roll of web material;

a fixed position touch roller, said touch roller positioned to hold the narrow web sheet around the roll being formed on said at least one core holding assembly; and a cutting head located adjacent said touch roller for selectively cutting the narrow width sheet along the width thereof;

two roll delivery assemblies, each said roll delivery assembly being located below said support rails associated with a separate one of said roll forming assemblies so that said core holding assembly of said roll forming assembly travels above said roll delivery assembly, each said roll delivery assembly including:

a lift unit, said lift unit having a top-located roll resting surface that is selectively positioned underneath said core holding assembly of said roll forming assembly to receive the formed roll carried by said core holding assembly;

an end web wrapping assembly including: a pair of rollers, said rollers being located on opposed sides of said lift unit adjacent said roll resting surface and being connected to said lift unit so as to have a first position wherein said rollers are located adjacent each other and above said roll resting surface so that said rollers support the formed roll and a second position wherein said rollers are spaced from each other, whereby when said rollers move from said first position to said second position, the formed roll is transferred to said roll resting surface; and a motor attached to one of said rollers for rotating said roller so as to cause rotation of the formed roll disposed on said rollers; and a core feeding unit attached to said lift unit, said core feeding unit including at least one selectively vertically positionable member for holding a new core and positioning the new core between said core holding frames of said roll forming assembly; and Sequence control means connected to said roll forming assemblies and to said roll delivery assemblies for controlling operation of said roll forming assemblies and said roll delivery assemblies, whereby, when a roll is completely formed on one of said core holding assemblies, said sequence control means is configured to: position said core holding assembly of said roll forming assembly and said roll delivery assembly associated therewith so that the formed roll is unloaded onto said end web wrapping assembly rollers while the narrow width web sheet forming the formed roll extends from said slitting assembly; position said core holding assembly so that the new core is unloaded from said core feeding unit and mounted to said core holding frames; position said core holding assembly so that the new core is held against the narrow web sheet between said cutting head and the formed roll so that the new core serves as a cutting support for the cutting head; actuate said cutting head and said core-driving motor so that the narrow web sheet is simultaneously cut from the formed roll and rolled around the new core;

actuate said end web wrapping assembly roller motor so that the end of the narrow web sheet extending from the formed core is wrapped around the formed roll; and actuate said end web wrapping assembly to lower the formed roll onto said roll resting surface of said lift unit of said roll delivery assembly.

2. The slitter rewinder of claim 1, wherein said lift unit, said end wrapping assembly and said core feeding unit of said roll delivery assembly are mounted on a movable carriage.

3. The slitter rewinder of claim 1, wherein at least one said roll delivery assembly is formed with a conveyor that functions as said roll resting surface, said conveyor being configured to transport the formed roll off of said roll delivery assembly.

4. The slitter rewinder of claim 3, wherein said lift unit, including said conveyor, said end wrapping assembly and said core feeding unit of said roll delivery assembly are mounted on a movable carriage.

5. The slitter rewinder of claim 1, wherein said slitting assembly includes a transfer mechanism for selectively positioning said at least one slitter knife along the width of the elongated width web.

6. The slitter rewinder of claim 1 wherein:

said slitting assembly includes a plurality of said slitting knives for cutting the elongated width web sheet into at least three narrow width web sheets and a transfer mechanism for selectively positioning said knives along the width of the elongated width web;

at least one said roll forming assembly has a plurality of core holding assemblies for forming separate rolls;

said core holding frames associated with both said roll forming assemblies are independently movable along said cross rails from which said core holding frames are suspended so that each pair of core holding frames forming one said core holding assembly is positioned to hold rolls of variable width.

7. The slitter rewinder of claim 6, wherein at least one said roll delivery assembly is formed with a conveyor that functions as said roll resting surface, said conveyor being configured to transport the formed roll off of said roll delivery assembly.

8. A slitter rewinder for receiving a continuous length, elongated width sheet of web material and forming core-center rolls of the web material, said slitter rewinder assembly including:

a feed assembly for receiving the elongated width web sheet and transporting the elongated width web sheet in a feeding direction;

a slitting assembly positioned to receive the elongated web sheet from said feed assembly, said slitting assembly being positioned to extend across the width of the elongated width web sheet and including:

a first guide rail positioned to extend across the width of the elongated width web sheet;

a plurality of slitting units slidably mounted to said first guide rail, each said slitting unit having a knife for cutting the elongated width web sheet into a plurality of narrow width web sheets; and a single transfer mechanism positioned to travel across the width of the elongated width web sheet and configured to be selectively couplable to each said slitting unit so as to move each said slitting unit to a desired position along said first guide rail so that the width of the narrow web sheets cut by said slitting assembly is changed;

two roll forming assemblies, said roll forming assemblies being located on opposed sides of said slitting assembly for each receiving at least one narrow width web sheet therefrom, each said roll forming assembly including:

a support frame having elevated support rails that extend from a position proximal to said slitting assembly to a position distal from said slitting assembly;

a cross rail assembly including a cross rail attached to said support frame rails to move along said support rails and a drive unit connected to said cross rail to move said cross rail along said support rails;

at least one core holding assembly suspended from said cross rail, said core holding assembly including: two core holding frames mounted to said cross rail to move along said cross rail, said core holding frames being configured to rotatably support a core therebetween; a drive mechanism for moving said core holding frames along said cross rail so that said core holding assemblies can be positioned to hold cores of variable length; and a core-driving motor attached to one said core holding frame for rotating the core supported by said core holding assembly so as to wrap the narrow web sheet around the core so as to form a roll of web material;

a fixed position touch roller, said touch roller positioned to hold the narrow web sheet around the roll being formed on said at least one core holding assembly; and a cutting head located adjacent said touch roller for selectively cutting the narrow width sheet along the length thereof;

two roll delivery assemblies, each said roll delivery assembly being located below said support rails associated with a separate one of said roll forming assemblies so that said core holding assembly travels above said roll delivery assembly, each said roll delivery assembly including:

a movable carriage;

a lift unit attached to said carriage, said lift unit being configured to be selectively positioned underneath said core holding assembly so as to receive the formed roll carried by said core holding assembly; and a core feeding unit attached to said carriage, said core feeding unit including at least one selectively vertically positionable member for holding a new core and positioning the new core between said core holding frames; and sequence control means connected to said roll forming assemblies and to said roll delivery assemblies for controlling operation of said roll forming assemblies and said roll delivery assemblies, whereby, when a roll is completely formed on one of said core holding assemblies, said sequence control means is configured to: position said core holding assembly and said roll delivery assembly associated therewith so that the formed roll is unloaded onto said roll delivery assembly lift unit while the narrow width web sheet forming the formed roll extends from said slitting assembly; position said core holding assembly so that the new core is unloaded from said core feeding unit and mounted to said core holding frames; position said core holding assembly so that the new core is held against the narrow web sheet between said cutting head and the formed roll so that the new core serves as a cutting support for the cutting head; and actuate said cutting head and said core-driving motor so that the narrow web sheet is simultaneously cut from the formed roll and rolled around the new core.

9. The slitter rewinder of claim 8 wherein said slitter assembly includes a second guide rail parallel to said first guide rail; said transfer mechanism is configured to travel along said second guide rail; and said transfer mechanism is connected to a reversibly rotatable lead screw that extends along the width of the elongated width web sheet for selectively moving said transfer mechanism along said second guide rail.

10. The slitter rewinder of claim 9, wherein at least one said slitter knife is retractably attached to said slitter unit with which said knife is associated so that said slitter knife has an extended position wherein said knife cuts the elongated width web sheet and a retracted position wherein said knife is spaced from the elongated width web sheet.

11. The slitter rewinder of claim 8 wherein at least one said slitter knife is retractably attached to said slitter unit with which said knife is associated so that said slitter knife has an extended position wherein said knife cuts the elongated width web sheet and a retracted position wherein said knife is spaced from the elongated width web sheet.

12. The slitter rewinder of claim 11, wherein said slitter assembly knives are mounted to said slitter units by pneumatically charged pistons and said pistons are selectively charged to move said knives between said extended and retracted positions.

13. The slitter rewinder of claim 12 wherein said roll delivery assembly lift unit is provided with a conveyor and is further provided with an end web wrapping assembly, said end web wrapping assembly including: a pair of rollers, said rollers being located on opposed sides of said lift unit adjacent said conveyor and being connected to said lift unit so as to have a first position wherein said rollers are located adjacent each other and above said lift unit conveyor so that said rollers support the formed roll and a second position wherein said rollers are spaced from each other, whereby when said rollers move from said first position to said second position, the formed roll is transferred to said lift unit conveyor; and a motor attached to one of said rollers for rotating said roller so as to cause rotation of the formed roll disposed on said rollers.

14. The slitter rewinder of claim 8, wherein at least one said roll delivery assembly lift unit is formed with a conveyor that functions as a surface on which the formed roll rests, said conveyor being configured to transport the formed roll off of said roll delivery assembly.

15. A slitter rewinder for receiving a continuous length, elongated width sheet of web material and forming core-center rolls of the web material, said slitter rewinder including:

a feed assembly for receiving the elongated width web sheet and transporting the elongated width web sheet in a feeding direction;

a slitting assembly positioned to receive the elongated web sheet from said feed assembly, said slitting assembly being positioned to extend across the width of the elongated width web sheet and having at least one slitter knife positioned for cutting the elongated width web sheet into a plurality of narrow width web sheets;

two roll forming assemblies, said roll forming assemblies being located on opposed sides of said slitting assembly for each receiving at least one narrow width web sheet therefrom, each said roll forming assembly including:

a support frame having elevated support rails that extend from a position proximal to said slitting assembly to a position distal from said slitting assembly;

a cross rail assembly including a cross rail attached to said support frame rails to move along said support rails and a drive unit connected to said cross rail to move said cross rail along said support rails;

at least one core holding assembly suspended from said cross rail, said core holding assembly including: two core holding frames mounted to said cross rail to move along said cross rail, said core holding frames being configured to rotatably support a core therebetween; a drive mechanism for moving said core holding frames along said cross rail; and a core-driving motor attached to one said core holding frame for rotating the core supported by said core holding assembly so as to wrap the narrow web sheet around the core so as to form a roll of web material;

a fixed position touch roller, said touch roller positioned to hold the narrow web sheet around the roll being formed on said at least one core holding assembly; and a cutting head located adjacent said touch roller for selectively cutting the narrow width sheet along the length thereof;

two roll delivery assemblies, each said roll delivery assembly being located below said support rails associated with a separate one of said roll forming assemblies so that said core holding assembly travels above said roll delivery assembly, each said roll delivery assembly including:

a movable carriage;

a lift unit attached to said carriage, said lift unit being configured to be selectively positioned underneath said core holding assembly so as to receive the formed roll carried thereby; and a core feeding unit attached to said carriage, said core feeding unit comprising a selectively vertically positionable core holding device, said core holding device having a pair of selectively vertically positionable core-holding grips for holding a new core and positioning the new core between said core holding frames, each said grip having an upright gripping surface and a base gripping surface that extends at an obtuse angle to said upright gripping surface, said gripping surfaces of said grips forming a profile of a tangential circle that enables tangential contact of the new core placed therebetween and a guide assembly connected between said core-holding grips for causing said grips to move in parallel with lines connecting a center of the circle inscribed by said core-holding grips so that said grips secure new cores of varying diameter at a constant center position; and sequence control means connected to said roll forming assemblies and to said roll delivery assemblies for controlling operation of said roll forming assemblies and said roll delivery assemblies, whereby, when a roll is completely formed on one of said core holding assemblies, said sequence control means is configured to: position said core holding assembly and said roll delivery assembly associated therewith so that the formed roll is unloaded onto said roll delivery assembly lift unit while the narrow width web sheet forming the formed core extends from said slitting assembly; position said core holding assembly and said core feeding unit so that the new core is unloaded from said core feeding unit and mounted to said core holding frames; position said core holding assembly so that the new core is held against the narrow web sheet between said cutting head and the formed roll so that the new core serves as a cutting support for the cutting head; and actuate said cutting head and said core-driving motor so that the narrow web sheet is simultaneously cut from the formed roll and rolled around the new core.

16. The slitter rewinder of claim 15, wherein at least one said roll delivery assembly lift unit is formed with a conveyor that functions as a surface on which the formed roll rests, said conveyor being configured to transport the formed roll off of said roll delivery assembly.

17. The slitter rewinder of claim 15, wherein said roll delivery assembly lift unit is provided with a conveyor and is further provided with an end web wrapping assembly, said end web wrapping assembly including: a pair of rollers, said rollers being located on opposed sides of said lift unit adjacent said conveyor and being pivotally connected to said lift unit so as to have a first position wherein said rollers are located adjacent each other and above said lift unit conveyor so that said rollers support the formed roll and a second position wherein said rollers are spaced from each other, whereby when said rollers move from said first position to said second position, the formed roll is transferred to said lift unit conveyor; and a motor attached to one of said rollers for rotating said roller when said rollers are in said first position so as to cause rotation of the formed roll disposed on said rollers.

18. The slitter rewinder of claim 15, wherein:

said slitting assembly includes a plurality of said slitting knives for cutting the elongated width web sheet into at least three narrow width web sheets and a transfer mechanism for selectively positioning said knives along the width of the elongated width web;

at least one said roll forming assembly has a plurality of core holding assemblies for forming separate rolls;

said core holding frames associated with both said roll forming assemblies are independently movable along said associated cross rails so that each pair of core holding frames forming one said core holding assembly can be positioned to hold rolls of variable width.

19. An automatic slitter rewinder machine comprising:

a feed-off apparatus for guiding and taking off a wide web sheet;

a slitting apparatus for slitting lengthwise the wide web sheet in a given slit width into a plurality of narrow web sheets;

split guide rollers for guiding the narrow web sheets in separate paths in the machine;

a plurality of pairs of core-holding frames for releasably supporting a core between each pair of core-holding frames and facilitating a winding up of the narrow web sheets onto the cores, the pairs of core-holding frames being disposed on upper frames on the machine that are oriented in spaced relation to a support floor for the machine, the core-holding frames being supported in a suspended manner from the upper frames for independent slidable movement thereon in both a longitudinal direction and a lateral direction;

a plurality of touch rollers for abutting the respective narrow web sheets being wound onto the cores;

automatic delivery means for cooperating with the pairs of core-holding frames after the cores have been wound to full rolls to thereby conduct automatically a series of roll changing steps of (1) releasing the full rolls from the pairs of core-holding frames, (2) supplying the pairs of core-holding frames in unoccupied state with new cores, (3) positioning the core-holding assemblies with the new cores against the narrow web sheets while the narrow web sheets are connected to the full rolls, (4) cutting the narrow web sheets away from the full rolls and simultaneously encircling the leading ends of the narrow web sheets around the new cores, wherein the cutting of the narrow web sheets forms trailing ends that extend from the full rolls, (5) transferring the full rolls to a location outside of the machine, (6) wrapping the trailing end of each full roll around the full roll, and (7) discharging the full rolls, the automatic delivery means being disposed below the pairs of core-holding frames on the support floor for the machine, and including a roll delivery carriage for receiving, conveying and discharging thereon the full rolls and a core-feeding lift for new cores, the roll delivery carriage and the core-feeding lift each including drive means for effecting an ascending and descending movement thereof independently of each other;

lateral rails mounted on the upper frames of the slitter rewinder machine for facilitating the aforesaid lateral movement of the pairs of core-holding frames, the pairs of core-holding frames being movable on the lateral rails in the lateral direction in conformity with the given slit width;

longitudinal rails mounted on the upper frames of the slitter rewinder machine for facilitating the aforesaid longitudinal movement of the pairs of core-holding frames, the pairs of core-holding frames gradually moving longitudinally thereon during winding, and during a build-up in roll diameter while retaining the abutting state of the touch rollers thereon and, after the core has been fully wound, the pairs of core-holding frames move longitudinally to a first position above the roll delivery carriage, a second position above the core-feeding lift, and a third position abutting the new cores on the touch rollers, wherein the pairs of core-holding frames move from the first position to the second position to the third position in sequence;

cutting devices having traverse knives positioned adjacent the touch rollers in a nip area between the touch rollers and new cores to facilitate a cut widthwise of the narrow web sheets, with the new cores serving as a cutting support for the traverse knives;

sequence control means for sequentially controlling the automatic delivery means while interlocking with the movement of the pairs of core-holding frames so that at the longitudinal first position of the pairs of core-holding frames the delivery carriage is elevated to receive the full rolls from the pairs of core-holding frames, at the longitudinal second position of the pairs of core-holding frames the core-feeding lift is elevated to supply the pairs of core-holding frames with new cores, and at the longitudinal third position of the pairs of core-holding frames the new cores abut the touch rollers and the narrow web sheets extending between the touch rollers so that the full rolls are cut by the cutting devices wherein the new cores serve as cutting supports;

the roll delivery carriage including a carriage for transferring the full rolls outside of the machine in the lateral direction, a carrying conveyor for carrying thereon the full rolls thereby to discharge them, a lifter mounted below the conveyor adapted to elevate and lower the conveyor, and a wrapping device for securing the trailing ends of the full rolls to the full rolls, the wrapping device being disposed at top of the delivery carriage to be swingingly movable above the carrying conveyor; and the core-feeding lift including a horizontal member supported for ascending and descending movement, air cylinders, interlinked with the horizontal member, for raising and lowering the horizontal member, and core-holding devices for the new cores, the core-holding devices having travelers slidably movable on the horizontal member.

* * * * *